US006475688B1

(12) United States Patent
Tamura et al.

(10) Patent No.: US 6,475,688 B1
(45) Date of Patent: Nov. 5, 2002

(54) ELECTROPHOTOGRAPHIC TONER, AND IMAGE FORMING APPARATUS AND IMAGE FORMING METHOD USING THE SAME

(75) Inventors: Kishio Tamura; Meizo Shirose, both of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/651,172

(22) Filed: Aug. 30, 2000

(30) Foreign Application Priority Data

Aug. 30, 1999 (JP) ..... 11-243096

(51) Int. Cl.[7] ..... G03G 9/087

(52) U.S. Cl. ..... 430/108.3; 430/108.4; 430/109.3

(58) Field of Search ..... 430/108.4, 108.3, 430/109.3, 109.31, 108.8

(56) References Cited

U.S. PATENT DOCUMENTS 4,626,490 A * 12/1986 Yamazaki et al. ..... 430/110.1
5,225,303 A * 7/1993 Tomita et al. ..... 430/108.4
5,447,813 A * 9/1995 Hagiwara et al. ..... 430/109.3
5,604,072 A * 2/1997 Unno et al. ..... 430/108.4
5,700,616 A * 12/1997 Kasuya et al. ..... 430/109.3
5,741,617 A * 4/1998 Inaba et al. ..... 430/108.4
5,863,692 A * 1/1999 Nakamura et al. ..... 430/108.4
5,998,079 A * 12/1999 Thompson et al. ..... 430/108.4
6,190,816 B1 * 2/2001 Takehara et al. ..... 430/109.3

OTHER PUBLICATIONS

Grant, Roger et al. Grant and Hackh's Chemical Dictionary. New York: McGraw–Hill Inc. p. 116. (1987).*

Diamond, Arthur S. (editor) Handbook of Imaging Materials. New York: Marcel–Deker, Inc. p. 178. (1991).*

* cited by examiner

*Primary Examiner*—Christopher Rodee
(74) *Attorney, Agent, or Firm*—Cantor Colburn LLP

(57) ABSTRACT

An electrophotographic toner is disclosed. The toner contains resinous composition comprising a lower molecular weight component having peak at molecular weight of 3,000 to 50,000 and a higher weight having peak at molecular weight of 100,000 to 5,000,000 of the copolymer comprised of vinyl based copolymer comprised of styrene based monomer and acrylic or methacrylic acid ester based monomer as structural units, and a fatty acid ester specified in the specification and a carboxylic acid specified in the specification.

32 Claims, No Drawings

ELECTROPHOTOGRAPHIC TONER, AND IMAGE FORMING APPARATUS AND IMAGE FORMING METHOD USING THE SAME

FIELD OF THE INVENTION

The present invention relates to an electrophotographic toner for developing electrostatic images in electrophotography, electrostatic recording, electrostatic printing, and the like, and an image forming apparatus.

BACKGROUND OF THE INVENTION

In electrophotography, in order to fix toner images onto sheets such as paper or the like, toners are thermally melted and fixed. So-called heat melt fixing is frequently employed. The heat melt fixing is mainly divided into two types, i.e. flash fixing in non-contact, and heated roll or heated belt fixing in contact. Of these, the heated roll and heated belt fixing subjects toners to melt while allowing toner images to come into contact with a heat transfer member. As a result, it is possible to expect to obtain high thermal efficiency. Thus said fixing is effective particularly for electrophotographic copiers, as well as printers, which output images at a high speed.

However, since in such heated roll and heated belt fixing, the heat transfer member is brought into direct contact with melted toner images, offset phenomenon tends to occur, in which a part of the toner image is adhered and transferred onto the heat transfer member, and retransferred to the subsequent fixing sheet to stain the resulting images. Further, when the heat transfer member comes into contact with a toner image, contact charging phenomenon occurs and a phenomenon occurs in which said heat transfer member is charged. Electrostatic charge accumulated in said heat transfer member, prior to contact with the forthcoming heat transfer member, electrostatically repels or attracts an unfixed toner image and thus turbulence of images or so-called image dust tends to be caused. This phenomenon occurs markedly in an image forming apparatus which fixes said images at a high speed.

In order to minimize said offset phenomenon, the supply of releasing oil to the fixing roll or the incorporation of offset preventing agents (occasionally referred to as releasing agents) have been carried out. However, the supply of said releasing oil causes a fixing device to be relatively complex, as well as increasing its dimensions. In addition, it is difficult to conduct a stable supply of said oil. Thus, it is impossible to achieve sufficient minimization of the offset. Further, the incorporation of said offset preventing agents into the toner is relatively effective for minimizing the offset. On the other hand, however, problems are accompanied in which charging toner is hindered. As a result, the image dust tends to be caused and it is not always possible to obtain high quality images.

In order to minimize the retardation for charging toners, charge control agents have been tried. However, since the chargeability of said charge control agents is great, it is difficult to achieve uniform dispersion in the toners. In addition, the dispersion of said releasing agents is degraded due to the strength of its chargeability, and it is impossible to sufficiently obtain the expected offset preventing effects.

SUMMARY OF THE INVENTION

It is an object of the present invention to obtain a high quality fixed image which exhibits sufficient fixed strength in the broad fixable temperature range, as well as forms no image dust.

The present invention and its embodiments will now be described.

1. An electrophotographic toner which comprises a resinous composition for toners having at least two peaks, one at a lower molecular weight of 3,000 to 50,000 and the other at a higher molecular weight of 100,000 to 5,000,000 of the copolymer which is comprised of, as the main component, vinyl based copolymers comprised of styrene based monomers as well as acrylic or methacrylic acid ester based monomers as the structural units along with a fatty acid ester represented by the general formulas (1-1) through (1-4), and a carboxylic acid represented by the general formula (2).

$$R_1RCOOR_2 \qquad \text{General Formula (1-1)}$$

(one or both of $R_1$ and $R_2$ represent an aliphatic group having at least 14 carbon atoms and when either $R_1$ or $R_2$ represents an aliphatic group having at least 14 carbon atoms, the other group may represent an alkyl group having no more than 14 carbon atoms, a cycloalkyl group, an alkenyl group, or an aralkyl group.)

$$[R_1COO—(CH_2)_n]_a—C—[(CH_2)_m—OCOR_2]_b \qquad \text{General Formula (1-2)}$$

(a and b each represents an integer of 0 to 4; a+b is 4; $R_1$ and $R_2$ each represents an organic group having from 1 to 40 carbon atoms; the difference in the number of carbon atoms between $R_1$ and $R_2$ is to be at least 3; m and n each represents an integer of 0 to 25; and m and n are not 0 at the same time.

$$[R_1COO—(CH_2)_n]_a—C—[(CH_2)_m—OH]_b \qquad \text{General Formula (1-3)}$$

(a represents an integer of 0 to 4; b represents an integer of 1 to 4; a +b is 4; $R_1$ represents an organic group having from 1 to 40 carbon atoms; m and n each represents an integer of 0 to 25; and m and n are not 0 at the same time.)

$$[R_1COO—(CH_2)_n]_a—C(R_3)_k—[(CH_2)_m—OCOR_2]_b \qquad \text{General Formula (1-4)}$$

(a and b each represents an integer of 0 to 3; a+b is 1 to 3; $R_1$ and $R_2$ each represents an organic group having from 1 to 40 carbon atoms; the difference in the number of carbon atoms between $R_1$ and $R_2$ is at least 3; $R_3$ represents a hydrogen atom or an organic group having at least 1 carbon atom (however, when a+b is 2, either one of R3 represents an organic group having at least 1 carbon atom); k represents an integer of 1 to 3; m and n each represents an integer of 0 to 25; and m and n are not 0 at the same time.)

$$R_4—COOH \qquad \text{General Formula (2)}$$

($R_4$ represents a saturated or unsaturated aliphatic group having at least 13 carbon atoms.)

2. An electrophotographic toner comprising a compound represented by general formula (3), described below, along with a resinous composition for toners having at least two peaks, one at a lower molecular weight of 3,000 to 50,000 and the other at a higher molecular weight of 100,000 to 5,000,000 of the copolymer which is comprised of, as the main component, vinyl based copolymers comprised of styrene based monomers as well as acrylic or methacrylic acid ester based monomers as the structural units.

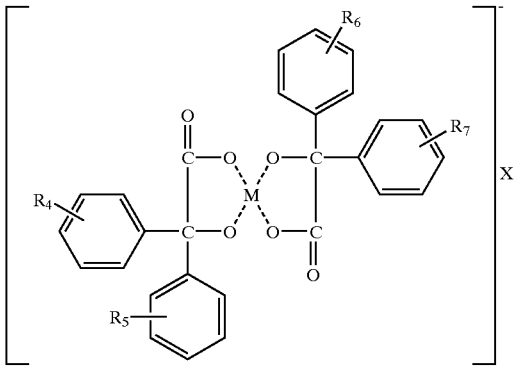

($R_4$ through $R_7$ each represents a hydrogen atom or a univalent substituent; a plurality of these may be substituted or may have a ring structure including a condensed ring. Further, $R_4$ through $R_7$ may be the same or different. M represents a trivalent metal, and X represents a univalent or divalent positive ion which neutralizes the electrical charge.)

3. The electrophotographic toner described in 2. above comprising a fatty acid ester represented by said general formula (1) as well as a carboxylic acid represented by said general formula (2).
4. The electrophotographic toner described in 1., 2., or 3. above comprising a crystalline compound having a low melting point.
5. The electrophotographic toner described in 1., 2., 3. or 4. above comprising a polyolefin component.
6. An electrophotographic toner comprising a resinous composition for toners, which is comprised of a matrix phase along with a domain phase which is dispersed in said matrix phase, a fatty acid ester represented by said general formula (1), and a carboxylic acid represented by said general formula (2).
7. An electrophotographic toner comprising a resinous composition for toners, which is comprised of a matrix phase along with a domain phase which is dispersed in said matrix phase as well as a compound represented by said general formula (3).
8. The electrophotographic toner described in 7. above comprising a fatty acid ester represented by said general formula (1) as well as a carboxylic acid represented by said general formula (2).
9. The electrophotographic toner described in 6., 7., or 8. above, comprising a crystalline compound having a low melting point.
10. The electrophotographic toner described in 6., 7., 8., or 9, above, comprising a polyolefin component.
11. An electrophotographic toner comprising a resinous composition for toners, which is comprised of a matrix phase along with a domain phase which is dispersed in said matrix phase, and in which a compatibilizer is contained in said domain phase and/or said matrix phase along with a fatty acid ester represented by said general formula (1), and a carboxylic acid represented by said general formula (2).
12. An electrophotographic toner comprising a resinous composition for toners, which is comprised of a matrix phase along with a domain phase which is dispersed in said matrix phase, and in which a compatibilizer is contained in said domain phase and/or said matrix phase, along with a fatty acid ester represented by said general formula (1).
13. The electrophotographic toner described in 12. above, comprising a fatty acid ester represented by said general formula (1) as well as a carboxylic acid represented by said general formula (2).
14. The electrophotographic toner described in 11., 12., or 13. above, comprising a crystalline compound having a low melting point.
15. The electrophotographic toner described in 11., 12., 13., or 15. above comprising a polyolefin component.
16. The electrophotographic toner described in any one of 11. through 15. above, in which said compatibilizer is a compound comprised of a block copolymer or graft copolymer comprising the same component as the matrix phase as well as the domain phase.
17. The electrophotographic toner described in any one of 11. through 16. above, in which said compatibilizer is a compound comprised of a polymer having a group which is capable of forming either a hydrogen bond or an ionic bond.
18. The electrophotographic toner described in any one of 11. through 17. above, in which volume standard 10 percent average particle diameter D10, volume standard 50 percent average particle diameter D50, and volume standard 90 percent average particle diameter D90 satisfy the formula described below.

$$D10>0.5\times D50$$

$$D90<1.5\times D50$$

19. An image forming apparatus wherein the electrophotographic toner described in any one of 1. through 18. above is employed, and said toner is melted by passing it through a heated roll and an image is formed by subjecting the resulting toner to be fixed onto an image carrying member.
20. The image forming apparatus described in 19. above, having therein a fixed heat generating member and a heated roll fixing device, employing a rotatable cylindrical heat transmitting member around said heat generating member.
21. The image forming apparatus described in 19. above, employing therein a rotatable cylindrical member and a heat generating member installed adjacent to the surface of said cylindrical member are employed.
22. An image forming apparatus wherein an image is formed in such a manner that while employing the electrophotographic toner described in any of 1. through 18. above, said toner is melted and fixed onto an image carrying member, employing a fixed heat generating member and a heated belt fixing device having endless belt-shaped heat transmitting member mounted around said heat generating member.
23. An image forming apparatus wherein an image is formed in such a manner that the electrophotographic toner described in any of 1. through 18. above, is employed, and said toner is melted by passing it through a flash fixing device and is subsequently fixed onto an image carrying member. 24. An image forming method wherein an image is formed employing an image forming apparatus described in any of 19. through 23. above.

DETAILED DESCRIPTION OF THE INVENTION

The resinous composition for toners of the present invention includes a resinous composition which has a molecular weight distribution having two peaks, one in the high molecular weight region and the other in the low molecular weight region. Said resinous composition is obtained by blending, in addition to said resinous composition having a molecular weight distribution with two peaks, at least one type of ester represented by the aforementioned general formulas (1-1) through (1-4), a carboxylic acid represented by general formula (2), and a compound represented by general formula (3). By employing said resinous composition, the aforementioned offset is markedly minimized and sufficient chargeability, as well as fixability, is obtained.

The resinous composition for toners of the present invention is comprised of, as the main component, vinyl based copolymers composed of styrene based monomers and acrylic or methacrylic acid ester based monomers as the structural units.

The aforementioned styrene monomers include, for example, styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrne, p-n-dodecylstyrene, p-methoxystyrene, p-phenylstyrene, p-chlorostyrene, 3,4-dichlorostyrene, and the like.

The aforementioned acrylic or methacrylic acid ester based monomers include, for example, acrylic or methacrylic alkyl esters such as methyl acrylate or methacrylate, ethyl acrylate or methacrylate, propyl acrylate or methacrylate, n-butyl acrylate or methacrylate, isobutyl acrylate or methacrylate, n-octyl acrylate or methacrylate, dodecyl acrylate or methacrylate, 2-ethylhexyl acrylate, stearyl acrylate, and the like, further 2-chloroethyl acrylate, phenyl acrylate or methacrylate, methyl α-chloroacrylate, dimethyl aminoethyl methacrylate, diethyl aminoethyl methacrylate, 2-hydroxyethyl methacrylate, glycidyl methacrylate, bisglycidyl methacrylate, polyethylene glycol dimethacrylate, methacryloxyethyl phosphate, and the like. Of these, methyl methacrylate, ethyl acrylate or methacrylate, propyl acrylate or methacrylate, n-butyl acrylate or methacrylate is particularly preferred.

The aforementioned vinyl based copolymers may comprise other vinyl based monomers. Such other vinyl based monomers include, for example, acrylic or methacrylic acids and α- or β-alkyl derivatives thereof such as acrylic or methacrylic acid, α-ethylacrylic acid, crotonic acid, and the like; unsaturated dicarboxylic acids and monoester or diester derivatives thereof such as fumaric acid, maleic acid, citraconic acid, itaconic acid, further monoacroyloxyethyl succinate, metacryloyloxyethyl succinate, acrylonitrile or metacrylonitrile, acrylamide, and the like.

In the present invention, employed are copolymer compositions for the toner, having a peak in each molecular weight distribution. Namely, these copolymers are comprised of one having a molecular weight distribution preferably in the range of 3,000 to 50,000 in terms of the weight average molecular weight, more preferably in the range of 5,000 to 20,000, and most preferably in the range of 8,000 to 15,000 in the low molecular weight region, and the other having a molecular weight distribution in the range of 100,000 to 5,000,000, preferably in the range of 500,000 to 2,000,000, and more preferably in the range of 800,000 to 1,200,000 in the high molecular weight region.

Said copolymer compositions having two peaks in their molecular weight distribution may be obtained, for example, by simply blending two binder resins, prepared separately, under the various conditions described below. However, it is preferable that low molecular weight polymers or high molecular weight polymers are previously produced and if desired, vinyl type monomers as well as polymerization initiators are further added in the presence of the compatibilizers described below, and for instance the resulting mixture may undergo radical polymerization in the solution. By such polymerization, a binder resin having the molecular weight distribution having peaks is obtained. In the aforementioned preferred examples, two molecular weight components constitute a uniform domain structure without causing pronounced layer separation.

Namely, the resinous composition for toners of the present invention is the one which is formed by matrix phases as well as domain phases dispersed in said matrix phases.

In said resinous components of the present invention, those composing the matrix phases are comprised of low molecular weight vinyl based resinous components. The weight average molecular weight of said components is between 3,000 and 50,000. The glass transition temperature of the same is preferably at least 50° C., but is more preferably between 50 and 75° C. The content of the same is preferably between 60 and 95 weight percent by weight with respect to the entire resinous components, and is more preferably between 65 to 90 percent by weight. Such low molecular weight vinyl based components are soft and tough, and markedly affect fixability at low temperature, as well as offset resistance. By controlling said resinous components to stay within the aforementioned ranges, the fixability as well as the offset resistance is further improved.

Further, the resinous components composing the domain phases are comprised of high molecular weight vinyl based components. The glass transition point Tg of said components is preferably between 50 and 75° C. The weight average molecular weight of the same is preferably between 100,000 and 5,000,000, is more preferably between 150,000 and 2,000,000, and is further more preferably between 150,000 and 1,500,000. The content of the same is preferably between 5 and 40 percent by weight with respect to the sum of the resinous components. The molecular weight distribution Mw/Mn is to be at least 4, and is preferably between 5 and 80. Such high molecular weight vinyl based. resinous components are hard as well as brittle, and thus affect brittleness as well as blocking resistance. By subjecting said resinous components to stay within the aforementioned ranges, the brittleness as well as the blocking resistance is further improved.

When toner performance such as blocking resistance, low temperature fixability, and the like, are noted, the softening point of components in the low molecular region, which compose the matrix phases, is preferably between 80 and 150° C., and is more preferably between 85 and 140° C. Further, variance (weight average molecular weight/number average molecular weight) in the molecular weight distribution is preferably no more than 5, and is most preferably no more than 4.

Herein, the softening point was determined as follows. By employing an elevated type flow tester, one gram of a sample is extruded from the narrow hole of a die (1 mm diameter×1 mm) under conditions of a load of 20 kg/cm$^2$ and a rate of temperature increase of 6° C./minute, and a flow curve is drawn which shows the relationship between the plunger descending distance and the temperature. Then the softening point was obtained as being the temperature when the descending distance of said plunger was one half of the full stroke. Further, the variance in the molecular weight distribution is the ratio of weight average molecular weight to number average molecular weight which is measured employing gel permeation chromatography.

The inventors of the present invention have discovered that the toner achieves the aforementioned objects of the present invention, which comprises resinous compositions which have a molecular weight distribution having two peaks and are comprised of matrix phases as well as domain phases dispersed in said matrix phases along with at least one type of fatty acid esters represented by general formulas (1-1) through (1-4) and a compound represented by general formula (2).

Namely, at least one type of fatty acid ester represented by general formals (1-1) through (1-4) as well as a carboxylic acid represented by the general formula (2) is incorporated into the toner of the present invention.

$$R_1COOR_2 \qquad \text{General Formula (1-1)}$$

wherein at least one of $R_1$ and $R_2$ represents an aliphatic group having from 14 to 40 carbon atoms, preferably from 14 to 36 carbon atoms, and most preferably from 14 to 32 carbon atoms, and represents an alkyl group and an alkenyl group as the aliphatic group. Said alkyl groups include, for example, a myristyl group, an acetyl group, an octadecyl group, and the like. Further, said groups may be an alkyl group having a branch. Still further, the alkyl group may be substituted with another —OCO—$R_1$. Listed as alkenyl groups are an octadecenyl group and the like.

When either $R_1$ or $R_2$ represents an aliphatic group having from 14 to 40 carbon atoms, the other group may represent an alkyl group having no more than 14 carbon atoms, such as a methyl group, an ethyl group, a propyl group, a butyl group, a hexyl group, an octyl group, a decyl group, a dodecyl group, and the like, a cycloalkyl group such as a cyclohexyl group, a cyclopentyl group, an alkenyl group such as a vinyl group, an allyl group, a butenyl group, a hexenyl group and the like, or an aralkyl group such as a benzyl group, a furfuryl group. Further, these alkyl groups, as well as aralkyl groups, may have a branch such as, for example, an isopropyl group, a tert-butyl group, a sec-butyl group, an ethylhexyl group, and the like. Still further, they may have a branch as exemplified by an isobutenyl group. The sum of the number of carbon atoms of $R_1$ and $R_2$ is at least 15, and is preferably between 15 and 60.

$$[R_1COO—(CH_2)_n]_a—C—[(CH_2)_m—OCOR_2]_b \qquad \text{General Formula (1-2)}$$

wherein a and b each represents an integer of 0 to 4; a+b is 4; $R_1$ and $R_2$ each represents an organic group having from 1 to 40 carbon atoms, and preferably from 2 to 36 carbon atoms; the difference in the number of carbon atoms between $R_1$ and $R_2$ is at least 3 and is most preferably 4 to 30; m and n each represents an integer of 0 to 25, and preferably an integer of 0 to 10; and m and n do not represent 0 at the same time.

$$[R_1COO—(CH_2)_n]_a—C—[(CH_2)_m—OH]_b \qquad \text{General Formula (1-3)}$$

wherein "a" represents an integer of 0 to 4; "b" represents an integer of 1 to 4; a+b is 4; $R_1$ represents an organic group having from 1 to 40 carbon atoms, and preferably from 2 to 36 carbon atoms; m and n each represents an integer of 0 to 25, and preferably of 0 to 10; and m and n are not 0 at the same time.

$$[R_1COO—(CH_2)_n]_a—C(R_3)_k—[(CH_2)_m—OCOR_2]_b \qquad \text{General Formula (1-4)}$$

("a" and "b" each represents an integer of 0 to 3; a+b is 1 to 3; $R_1$ and $R_2$ each represents an organic group having from 1 to 40 carbon atoms in integer, and preferably from 2 to 36 carbon atoms; the difference in the number of carbon atoms between $R_1$ and $R_2$ is at least 3, preferably 4 to 30; $R_3$ represents a hydrogen atom or an organic group having carbon atoms of at least 1 (however, when a+b is 2, either one of $R_3$ represents an organic group having at least 1 carbon atom); k represents an integer of 1 to 3; m and n each represents an integer of 0 to 25; and m and n are not 0 at the same time.)

It is possible to produce these esters employing well-known methods. Namely, methods are employed in which synthesis is carried out employing carboxylic acids and derivatives thereof, or ester incorporation reaction represented by the Michael addition reaction, and the like. Particularly preferred are methods in which dehydration condensation reaction of carboxylic compounds with alcoholic compounds is utilized or reaction of alcoholic compounds with acid halide compounds is utilized.

Specific examples of esters represented by general formula (1-1) include stearyl stearate, behenyl stearate, octyl stearate, decyl stearate, octyl melissinate, and the like. Further, as specific examples of esters represented by general formulas (1-2) through (1-4), Ester Compound No. 1
(having a molucular weight of 852)

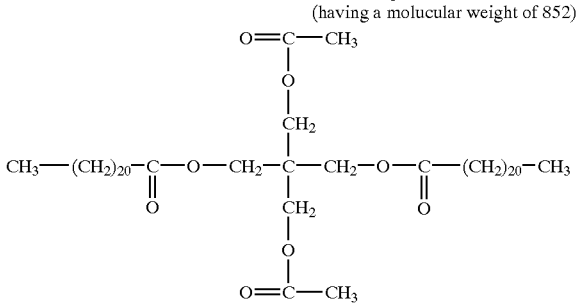

Ester Compound No. 2
(having a molucular weight of 626)

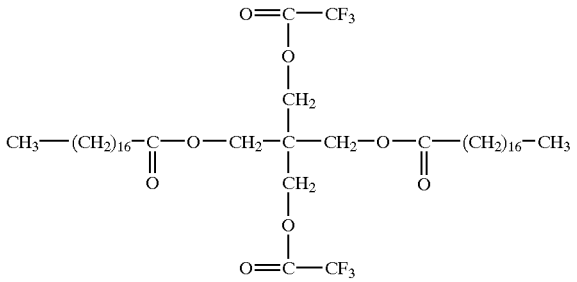

Ester Compound No. 3
(having a molucular weight of 972)

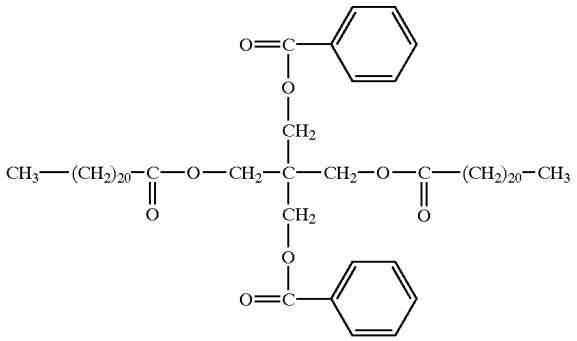

-continued

Ester Compound No. 4
(having a molecular weight of 1424)

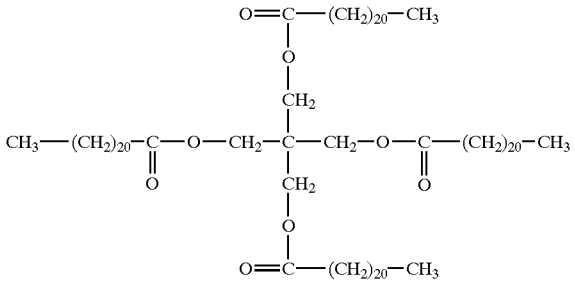

Ester Compound No. 5
(having a molecular weight of 1138)

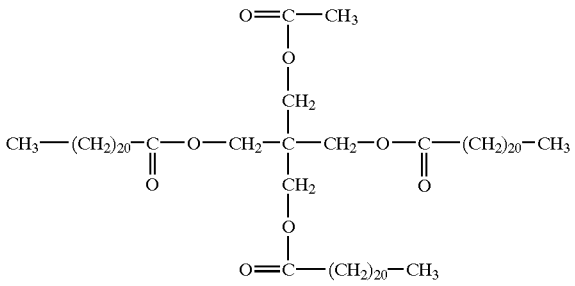

Ester Compound No. 6
(having a molecular weight of 1096)

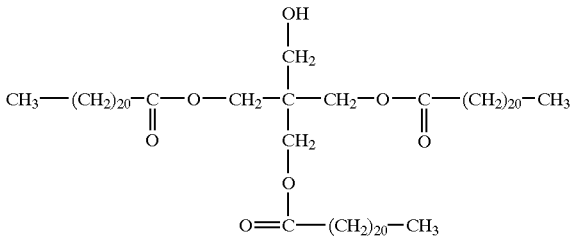

Ester Compound No. 7
(having a molecular weight of 1094)

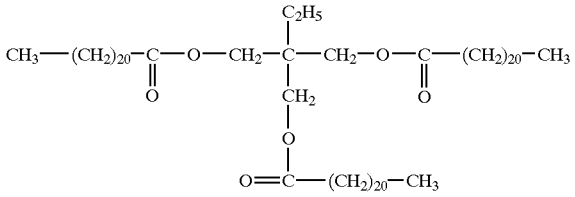

Ester Compound No. 8
(having a molecular weight of 736)

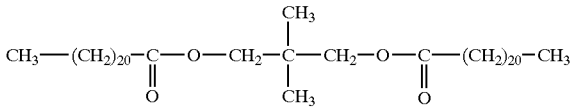

Ester Compound No. 9
(having a molecular weight of 722)

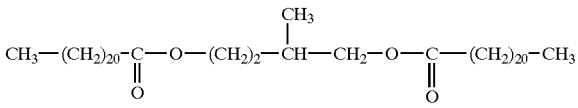

Ester Compound No. 10
(having a molecular weight of 566)

-continued

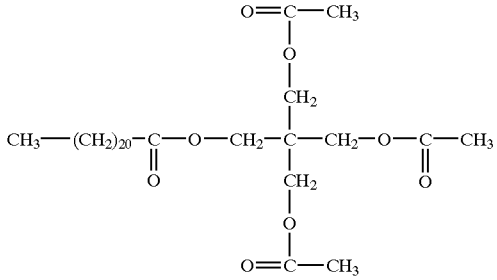

Ester Compound No. 11
(having a molecular weight of 1211)

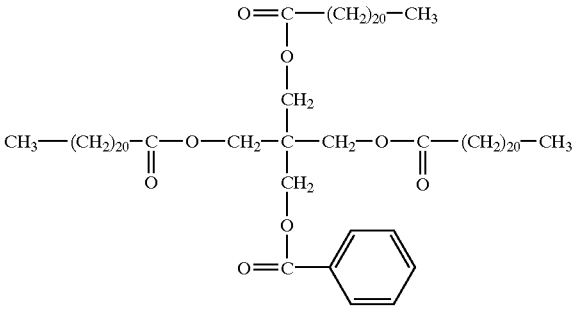

Ester Compound No. 12
(having a molecular weight of 770)

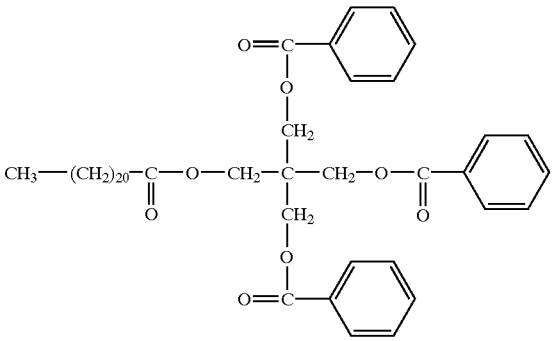

Ester Compound No. 13
(having a molecular weight of 536)

$CH_3-(CH_2)_{16}COO-(CH_2)_{17}CH_3$

Ester Compound No. 14
(having a molecular weight of 596)

$CH_3-(CH_2)_{18}COO-(CH_2)_{19}CH_3$

Ester Compound No. 15
(having a molecular weight of 648)

$CH_3-(CH_2)_{20}COO-(CH_2)_{21}CH_3$

Ester Compound No. 16
(having a molecular weight of 704)

$CH_3-(CH_2)_{22}COO-(CH_2)_{23}CH_3$ are listed.

Further, listed as carboxylic acids employed in the present invention are those represented by general formula (2).

$$R_4—COOH \qquad \text{General Formula (2)}$$

In carboxylic acids represented by general formula (2), $R_4$ represents a saturated or unsaturated aliphatic group having at least 13 carbon atoms. Examples of carboxylic acids having a saturated aliphatic group include myristic acid, pentadecylic acid, palmitic acid, heptadecylic acid, stearic acid, nonadecanic acid, arachidic acid, behenic acid, heptaconic acid, montanic acid, melistic acid, lacelic acid, and the like, while examples of carboxylic acids having unsaturated aliphatic group include linoleic acid, linoleic acid, arachidonic acid, and the like. Listed as preferred acids are behenic acid and stearic acid.

Of said compounds, the content of esters is generally in the range of 0.05 to 20 percent by weight with respect to the resinous components, and is preferably in the range of 0.15 to 10 percent by weight.

Further, the content of carboxylic acids is generally in the range of 0.001 to 5 percent by weight with respect to the resinous components, and is preferably in the range of 0.005 to 2 percent by weight.

Further, the content of preferred ester components is preferably between 80.0 and 99.0 percent by weight while the content of carboxylic acids is preferably between 0.1 and 20 percent by weight.

Compounds represented by the aforementioned general formula (3) are incorporated into the resinous composition of the present invention. Further, these compounds are well dispersed along with resinous components, and exhibit thermal stability at temperatures at which melt-kneading can be carried out efficiently. In addition, these are colorless substances and also are capable of imparting a negative charge to the toner. Thus it is possible to provide the toner with excellent chargeability.

In the formula, $R_4$ through $R_7$ each represents a hydrogen atom, and a univalent substituent, and preferably represents a halogen atom, an alkyl group, an alkoxy group, an aryl group, an aralkyl group, a hydroxyl group, a carboxyl group, a nitro group, a cyano group, and the like.

The halogen atom represents an atom such as fluorine, chlorine, bromine, and the like, and alkyl groups such as an alkyl group, an alkoxy group, and the like are the same as those represented by $R_1$ and $R_2$ in the aforementioned fatty acid esters as well as fatty acids. The aryl groups include unsubstituted aryl groups such as a phenyl group as well as a naphthyl group, and further these substituents may be further substituted with another substituents such as a tolyl group, a methoxyphenyl group, a chlorophenyl group, a hydroxyphenyl group, a carboxyphenyl group, a cyanophenyl group, and the like. The aralkyl groups include groups such as a benzyl group, a phenetyl group, and the like, and these groups may be further substituted with substituents such as those described above. Further, each phenyl ring may be substituted with a plurality of these groups, and for instance, a dichlorophenyl, a trichlorophenyl group, and the like, may also be employed. Still further, these substituents may form a condensed ring such as a naphthyl ring and the like, along with a phenyl ring.

M represents a trivalent metal, and said metal may be selected from Cr, Al, Fe, Co, Ti, B, and the like. Employed as univalent or divalent cations represented by X, which are employed to neutralize the charge, can be various types of inorganic cations, as well as organic cations. Listed as inorganic cations are hydrogen ions and metal ions. Listed as univalent, as well as divalent metal ions, are $Li^+$, $Na^+$, $K^+$, $Mg^{2+}$, $Ca^{2+}$, $Zn^{2+}$, and the like. Further, listed as organic cations are an ammonium ion, an iminium ion, a phosphonium ion, and the like. When X is a divalent cation, it is regarded as one half equivalent to neutralize charge.

Of the aforementioned organic cations, those which are preferred are represented by general formulas (3-1), (3-2), and (3-3) or (3-4) described below.

General Formula (3-1)

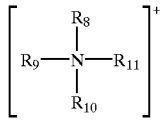

General Formula (3-2)

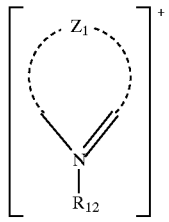

General Formula (3-3)

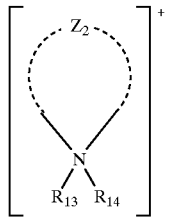

General Formula (3-4)

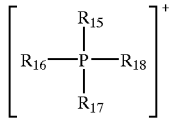

wherein $R_8$, $R_9$, $R_{10}$, $R_{11}$, $R_{12}$, $R_{13}$, $R_{141}$ $R_{15}$, $R_{16}$, $R_{17}$, and $R_{18}$ each represents a hydrogen atom, a substituted or unsubstituted alkyl group, or a substituted or unsubstituted aryl group, while $Z_1$ and $Z_2$ each represents a nonmetallic atomic group which bonds to a nitrogen atom in each formula to form a 5-membered or 6-membered ring. Herein, listed as an alkyl group may be, for example, a methyl group, an ethyl group, an iso-amyl group, a n-dodecyl group, a n-octadecyl group, a cyclohexyl group, and the like. Listed as an aryl group may be, for example, a phenyl group, an α-naphthyl group, and the like.

These alkyl groups or aryl groups may be substituted with various types of substituents such as an alkyl group, an. aralkyl group, a halogen, an alkoxy group, a hydroxyl group, a cyano group, an aryl group, and the like. Further, $Z_1$ and $Z_2$ each represents a nonmetallic atomic group necessary for forming various types of heterocyclic rings such as, for example, a pyridine ring, an isoquinoline ring, a pyrrole ring, an imidazole ring, a piperazine ring, a pyrrolidine ring, and the like.

Specific examples of compounds represented by general formula (3) are shown blow.

1.
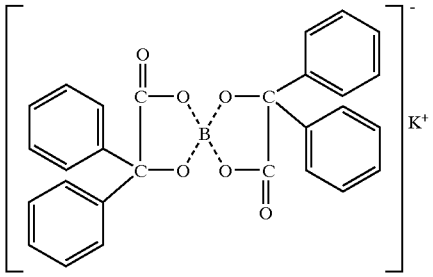
2.
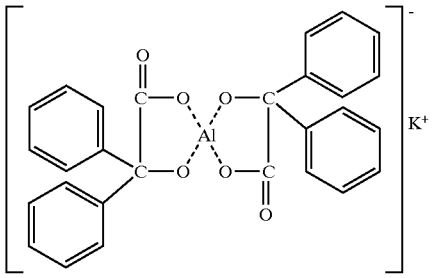
3.
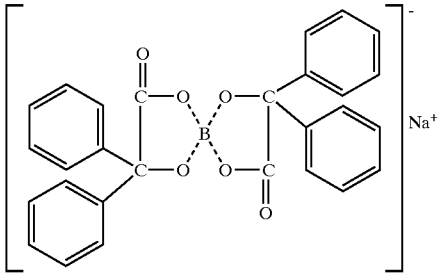
4.
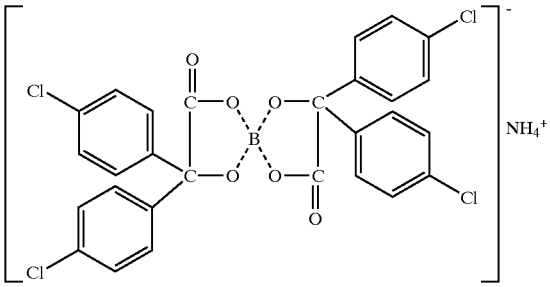
5.
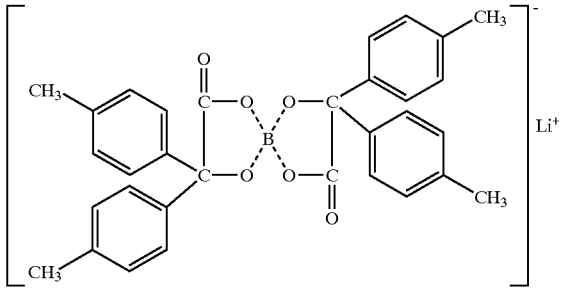
6.
-continued
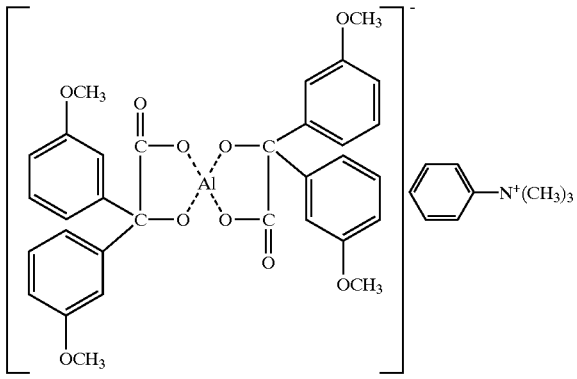
7.
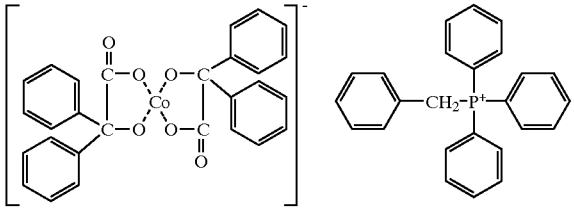
8.
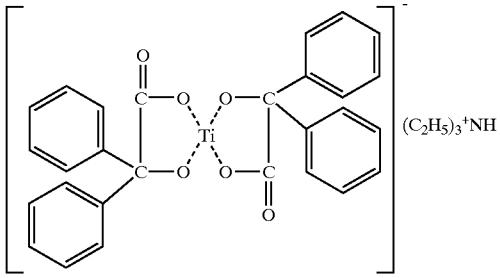
9.
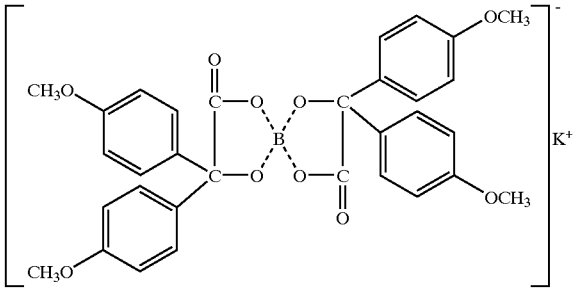
10.
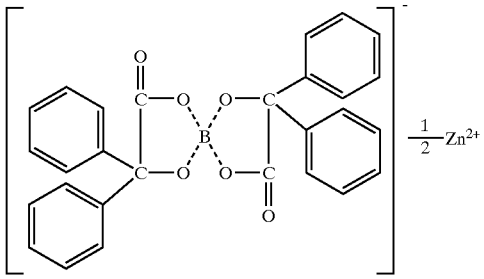
11.

-continued

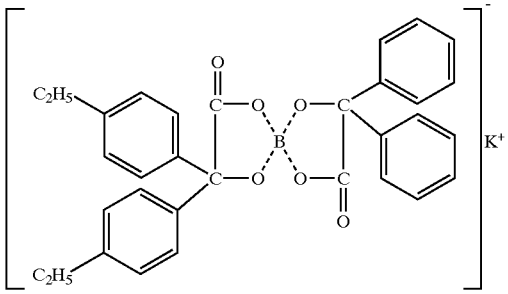

12.

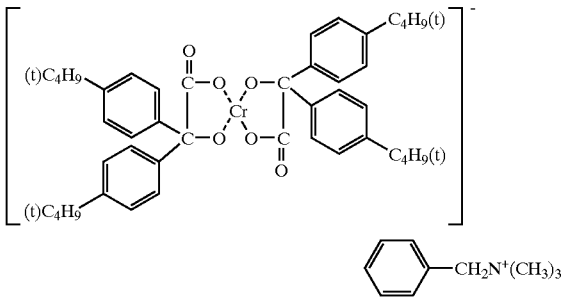

The compounds represented by general formula (3), which are employed as the charge control agents of the present invention, are obtained employing a method described in, for example, Japanese Patent Publication No. 7-13765.

The added amount of these compounds represented by general formula (3), which are incorporated into toner components, is generally between 0.1 and 10 weight parts with respect to 100 weight parts of the resin, and is preferably between 0.5 and 5 weight parts.

Further, crystalline compounds having a low melting point are preferably incorporated in the present invention.

Said crystalline compounds, having a low melting point employed in the present invention, are those having a polar group at their terminals. Preferred polar groups include, for example, —OH, —N═, —S—, —COOH, —CHO, —$SO_3$, —CN, —$NO_2$, and a halogen atom. Of said crystalline substances, those having —OH (a hydroxyl group) are preferred due to the ease of controlling the charge amount of toner as well as their ease of synthesis.

Said crystalline compounds having a low melting point preferably have a melting point of 50 to 130° C. When the melting point is below 50° C., storage stability is degraded, while when the melting point is at least 130° C., fixability at lower temperatures is occasionally degraded.

Listed as said crystalline compounds having a low melting point are low molecular weight crystalline compounds as well as the crystalline polymers described below. Specific examples of said low molecular weight crystalline compounds include, for example, higher alcohols such as 1-hexadecanol, 1-heptadecanol, stearyl alcohol, 1-nonadecanol, 1-eicosanol, 1-docosanol, 1-tricosanol, 1-tetracosanol, ceryl alcohol, and the like; higher fatty acids such as palmitic acid, heptadecanic acid, stearic acid, nonadecanic acid, eicosanic acid, behenic acid, triconsanic acid, lignoceric acid, and the like, as well as esters thereof; and further fatty acid amides such as linoleic acid amide, ricinoleic acid amide, erucic acid amide, oleinic acid amide, eicosanic acid amide, ercicic acid amide, palmitoleic acid amide, and the like.

Further, specific examples of said crystalline polymers include, for example, polyesters obtained by polycondensing polyols such as ethylene glycol, 1,3-propylene glycol, 1,4-butanediol, 1,5-pentanediol, 1,6-hexanediol, hexamethylene glycol, tetramethylene glycol, and the like with polybasic acids such as fumaric acid, maleic acid, itaconic acid, terephthalic acid, succinic acid, adipic acid, sebacic acid, and the like; polyethers such as polyethylene glycol, polypropylene glycol, and the like; polymers having as the primary polymerization devices long chain alkyl esters such as behenyl acrylate, behenyl methacrylate, behenyl itaconate, stearyl itaconate, and the like.

Of these, crystalline polyesters are particularly useful. Representative examples include crystalline polyester resins (HP-320 of Nihon Gosei Kagaku Co., Ltd.) (having a Tsp of 80° C.).

The content of said crystalline compounds, having a low melting point, is between 1 and 30 percent by weight with respect to the resinous composition. When the content of said crystalline compounds, having a low melting point, is below one percent by weight, the entire crystallinity of the resinous composition decreases to degrade the fixability at lower temperatures, while when the content of the same exceeds 30 percent by weight, the plasticity of the resinous composition progresses to degrade storage stability.

In the present invention, in order to improve the offset properties of toner during thermal fixing, it is preferable that further employed as releasing agents are polyolefin waxes of olefins such as low molecular weight polypropylene, low molecular weight polyethylene, ethylene-propylene copolymers, and the like.

The softening point (determined in accordance with the ring and ball method of JIS K 2531) of polyolefin wax releasing agents is preferably in the range of 100 to 160° C. Of these, particularly preferred are low molecular weight olefin waxes having a number average molecular weight of 2,000 to 8,000, that is, low molecular weight polypropylene and low molecular weight polyethylene. Listed as any of these examples are polypropylenes (Viscol 660P).

The blending ratio for addition of these releasing agents is preferably between 1 and 10 weight parts per 100 weight parts of the binder resin.

If desired, other releasing agents may be incorporated into the electrophotographic toner of the present invention. Listed as such are ikurocrystalline wax, carnauba wax, sazol wax, paraffin wax and the like, which have been conventionally employed. When added, they are blended within the aforementioned range.

In the resinous compositions for toners which are comprised of matrix phases as well as domain phases dispersed into said matrix phases, compatibilizers, other than the aforementioned additives, are preferably incorporated.

Employed as the compatibilizers. used in the present invention are block copolymers, graft copolymers, star-shaped polymers, and the like, which comprise the same components as the matrix phase and the domain phase, or components which are compatible with both phases or one of the phases. Of these, preferably employed are block polymers or graft copolymers.

The reasons to employ the block copolymers, graft copolymers, star-shaped polymers, and the like, are as follows. These decrease free energy localized in the interface, and stabilize the less shaped domains. Thus these exhibit effects to markedly enhance the interaction of each interface.

For instance, in the case of a diblock copolymer comprised of two components similar to the components of the domain phase as well as the matrix phase, each of homopolymer components is compatible with each of the matrix phase and the domain phase and is capable of generating strong interaction between both phases. Consequently, the domain phase as well as the matrix phase is provided with the interaction, and the viscosity of all the resins is increased. As a result, the offset resistance is markedly improved.

It is preferable that without breaking each independent structure of the domain phase and the matrix phase, compatibilizers are localized in the interface, and generate strong interaction between both phases. Resin compositions, which are readily compatible with each phase, are comprised of at least one of said resin components which are capable of forming the matrix phase as well as the domain phase. Resin components are selected from, for example, vinyl based resins, xylene resins, epoxy resins, coumarone-indene resins, SBS resin, and the like. Specifically and suitably employed are vinyl based resins. Of these, styrene based copolymers, acrylic or methacrylic ester based copolymers, and styrene-acrylic or methacrylic copolymers are more suitable.

Employed as one type of compatibilizers are polymers having in the molecular chain a functional group capable of forming a hydrogen bond or an ionic bond. Such compatibilizers having such functional groups are dispersed in resinous compositions (the domain phase as well as the matrix phase) for said toner, and allow molecules to perform strong psuedo-crosslinking so that the interaction between the domain phase and the matrix phase is strengthened. Consequently, the domain phase and the matrix phase are capable of carrying out cooperative movement and thus offset resistance is improved.

The compatibility of compatibilizers to each phase is preferably to such a degree that without destroying each independent structure of the domain phase as well as the matrix phase, an interaction between both phases is generated. Herein, preferably incorporated as the aforementioned functional groups in the high molecular polymers are a hydroxyl group, and compounds such as ketones, esters, ethers, nitrites, halogens, sulfides, thiols, organic phosphorus compounds, nitro compounds, and the like.

Selected as resinous compositions, which are readily compatible with each phase, are resins which are capable of carrying out interaction with the matrix phase as well as with the domain phase, and are specifically selected from vinyl based resins, epoxy resins, and the like. Suitably employed are particularly styrene based copolymers, sulfonated polystyrene, polyvinyl butyral, partially saponified vinyl acetates, polyethylene glycol, polyvinyl bromide, polyurethane, and the like.

Employed as the other types of compatibilizers used in the present invention are polymers having a solubility parameter (δ) between those in the matrix phase and in the domain phase. The δ value as described herein is calculated from the evaporation energy and volume per mole of a segment when a polymer chain is cut into segments having the approximately same volume as that of a solvent molecule, and is the value generally showing the chemical affinity of the polymer.

Reasons to employ such polymers are as follows: these polymers are localized at the interface and decrease free energy. Further, by decreasing domain sizes and stabilizing domains, the compatibilizers exhibit effects to markedly enhance the interaction at the interface.

Further, such polymers are partially compatible with the matrix phase as well as the domain phase and are capable of generating strong interaction between both phases. As a result, it is possible to minimize slippage of the domain phase and the matrix phase. Due to that, adhesive force between the domain phase and the matrix phase is enhanced, and the offset resistance is markedly improved.

Preferred compatibility of compatibilizers with each phase is in such a degree that without destroying each independent structure of the domain phase as well as the matrix phase, said compatibilizers are localized in the interface and generate strong interaction between both phases. The resinous compositions, which are readily compatible with each phase, are selected from, for example, vinyl based resins, xylene resins, epoxy resins, coumarone-indene resins, SBS resin, dines, and the like. Employed as particularly suitable resins are vinyl based resins. Of these, more suitable are styrene based copolymers, acrylic or methacrylic acid ester based copolymers, and styrene-acrylic or methacrylic acid copolymers. Specifically, styrene-n-butyl acrylate-methyl methacrylate copolymer (St-BA-MMA copolymer having a weight average molecular weight Wn of 500,000), which is employed in the production example of Example 1, is useful.

Employed as further different compatibilizers used in the present invention are polymers having a solubility parameter (δ), which is at most two than that of the matrix phase. Further, employed as the compatibilizers are those which preferably have a melt viscosity greater than the matrix phase.

The aforementioned polymers are employed to increase the melt viscosity of the matrix phase to decrease the domain sizes dispersed in the matrix phases and to control mechanical shearing force to effectively work on the interface of both phases.

Namely it is possible to markedly enhance the interaction between the domain phase and matrix phase by increasing the viscoelaciticity of the matrix phase as well as enhancing the dispersibility of the domain phase while allowing the matrix phase to be compatible with high molecular weight compounds having a high melt viscosity, which are perfectly compatible only with the matrix phase and are capable of forming an individual structure.

Such polymers are completely dissolved in the matrix phase and result in strong interaction between both phases by enhancing the viscoelaciticity of the matrix phase. Accordingly, it is possible to minimize slippage between the domain phase and the matrix phase. As a result, the offset resistance is highly improved.

Employed as resins which are readily compatible with each phase, as noted above, are vinyl based resins, diene based resins, and the like. Of these, employed may be butadiene, isoprene, isobutylene, polyethylene, and the like.

Employed as still other compatibilizers are polymers having a solubility parameter value (δ value) which is larger at most two than that of the domain phase. Further the melt viscosity of compatibilizers employed herein is greater than that of the domain resins.

Such polymers are employed to decrease the viscosity of the domain phase during melting by decreasing sizes of the domain dispersed in the matrix phase so that mechanical shearing force is effectively applied into both phases.

Namely it is possible to markedly enhance the interaction between the domain phase and the matrix phase by decreasing the viscoelaciticity of the domain phase as well as enhancing the dispersibility to the matrix phase while allowing the high molecular weight compounds having a low melt viscosity, which are compatible only with the domain phase and are capable of forming an individual structure, to be compatible with the domain phase.

The aforementioned polymers are completely dissolved in the domain phase and are capable of resulting in strong interaction between both phases by decreasing the viscoelaciticity of resins in the domain phase, and by enhancing the dispersibility of the domain phase. Accordingly, it is possible to minimize slippage between the domain phase and the matrix phase. As a result, it is possible to highly improve the offset resistance.

Employed as resins, which are readily compatible with the domain phase, are, for example, vinyl based resins. Of these, employed are polymethyl acrylate, polyethyl acrylate, polyvinyl acetate, polyvinyl butyral, partially saponified polyvinyl acetates, and the like.

The added amount of these compatibilizers is preferably in the range of 0.01 to 40 percent by weight with respect to the total resinous components (the sum of resinous components constituting the domain phase as well as the matrix phase). When the content of said compatibilizers is less than the lower limit, the offset resistance of resins is degraded, while when the content is greater than the higher limit, domain/matrix structure exhibits perfect compatibility and it is impossible to obtain excellent fixability.

As described above, the resinous compositions for the toner of the present invention are produced as follows. For example, a specified amount of compatibilizers are blended with high molecular weight vinyl based resinous components, and the resulting blend is melt kneaded, employing a roll mill, a kneader, an extruder, or the like. Thus the resinous components, which constitute the domain phase, are prepared. Then said domain phase constituting resinous components are blended in a specified ratio with high molecular weight vinyl based resinous components which constitute the matrix phase, and the resulting blend is further melt kneaded employing a roll mill, a kneader, an extruder, or the like.

Further, the resinous compositions for the toner of the present invention are also produced as follows. A specified amount of compatibilizers are blended with the aforementioned low molecular weight vinyl based resinous components, and the resulting blend is melt kneaded employing a roll mill, a kneader, an extruder, or the like. Thus the resinous components, which constitute the matrix phase, are prepared. Then said matrix phase constituting resinous components are blended in a specified ratio with high molecular weight vinyl based resinous components which constitute the matrix phase, and the resulting blend is further melt kneaded employing a roll mill, a kneader, an extruder, or the like.

Further, as described above, domain phase constituting resinous components, comprising the compatibilizers, and matrix phase constituting resinous components, comprising the compatibilizers are individually prepared, and these are melt kneaded employing a roll mill, a kneader, an extruder, or the like. Thus it is possible to produce the resinous compositions for toner of the present invention.

Further, in some cases, said low molecular weight vinyl based resinous components and high molecular weight resinous vinyl based components are blended together, and the resulting blend is melt kneaded employing a roll mill, a kneader, an extruder, or the like. Thus it is possible to produce the resinous compositions for toners of the present invention.

Still further, in some cases, it is possible to produce the resinous compositions for toners of the present invention by blending, in suitable organic solvents, said low molecular weight vinyl based resinous components as well as high molecular weight resinous vinyl based components with compatibilizers and fixing aids.

Still further, it is possible to produce the resinous compositions for toners of the present invention by blending compatibilizers with either or both resinous components during the polymerization process of said low molecular weight vinyl based resinous components as well as high molecular weight resinous vinyl based components. In this case, when monomers, which constitute resinous components, are specifically polymerized (or copolymerized) in the presence of monomers which constitute the other resinous components, it is possible to more economically produce the resinous compositions for toners. In addition, it is preferred because compatibilizers, being fine inorganic particles described below, and the like, can be readily incorporated.

In any of the methods described above, it is possible to control the dispersion state of both resinous components of the domain phase and the matrix phase of resinous compositions for toners in a state in which compatibilizers and other additives are selectively incorporated into the domain and/or matrix phase by suitably controlling the compositions of components of low molecular weight vinyl based polymers and high molecular weight vinyl based polymers, weight average molecular weights, glass transition temperatures, types of compatibilizers, types of other additives, solution blending conditions, polymerizing (copolymerizing) conditions, and melt-kneading conditions.

When both resinous components described above are uniformly compatible with each other at the molecular level, they exhibit a compatible structure (a monophase structure) in a homogeneous system, and properties of both resinous components are averaged. As a result, it is impossible to obtain the fixing temperature, offset resistance, blocking resistance, and pulverizing properties, which are required for toners. Contrary to this, when both resinous components described above are non-uniformly compatible with each other at the molecular level, they preferably exhibit a microscopically phase-separated structure (a double-phase structure) in a heterogeneous system.

The resinous compositions for toners of the present invention comprise the micro-phase separation structure in a heterogeneous system, described as the latter case above, and are specifically comprised of the matrix phase (a continuous phase) as well as the domain phase (a discontinuous phase) which is dispersed in said matrix phase, and compatibilizers are incorporated into said domain phase and/or in the interface with the matrix phase. Herein, the most important point is that when there is no interaction or small interaction between the matrix phase and the domain phase, or when the domain size is very large, the domain phase behaves independently in the matrix phase and thus does not contribute to the improvement of offset resistance, which is the effect obtained by the domain phase. As noted above, since the domain phase and the matrix phase are independent of each other, the adhesion at their interface is weak. Due to that, in order to result in strong interaction at said interface, compatibilizers are effectively employed.

Further, such special micro-phase separation structures include those in which, specifically, the domain phase is granular, cylindrical, lamellar, and a mutually interpenetrating net. Such a micro-phase separation structure (a double-phase structure) can be confirmed by observing, for example, an ultra-microtome slice with the use of a scanning or transmission type electron microscope, or the like.

In the resinous compositions for toners of the present invention, it is specifically preferable that the domain phase has a particle-shaped structure and the size of the domain particles is approximately no more than 5 $\mu$m. When resins comprised of domain particles having an excessively large size are employed to produce toners, the number of domain particles incorporated into toner particles fluctuate and critically affect various physical properties.

In the toner of the present invention, in addition to the aforementioned components, colorants are incorporated. Said colorants are not particularly limited, and various types of conventional colorants known in the art are employed. For example, listed are carbon black, Nigrosine dyes, Aniline Blue, Charcoyl Blue, Chrome Yellow, Ultramarine Blue, Du Pont Oil Red, Quinoline Yellow, Methylene Blue chloride, Phthalocyanine Blue, Malachite Green Oxalate, lamp black, Rose Bengal, or the like. The employed amount of colorants is generally in the range of 0.1 to 20 weight parts per 100 weight parts of the binder resin.

Further, employed as magnetic material particles, employed to obtain magnetic toners, are particles of ferrite, magnetite, or the like, having an average particle diameter of 0.1 to 2 $\mu$m. The added amount of magnetic particles is generally in the range of 20 to 70 percent by weight with respect to colored particles in the state in which external additives such as fine composite particles described below are removed.

Further, in order to enhance the flowability of toners, in addition to hydrophobic silica particles, toners may be constituted by externally adding fine inorganic particles such as titanium dioxide, and fine composite particles prepared by adhering silica or the like to fine organic particles. Specifically preferred as such fine inorganic particles are those which have been subjected to hydrophobic treatment employing silane coupling agents, titanium coupling agents, and the like.

It is preferable that in the particle distribution of the toner produced as described above, volume standard 10 percent average particle diameter D10, volume standard 50 percent average particle diameter D50, and volume standard 90 percent average particle diameter D90, satisfy the formula described below. When these conditions are satisfied, it is possible to obtain high quality fixed images which exhibit sufficient fixing strength over a wide fixing temperature range, and further form neither offset nor image dust.

$$D10>0.5\times D50$$

$$D90<1.5\times D50$$

The toner, which is produced employing the resinous composition of the present invention, exhibits sufficient fixing strength over a wide fixing temperature range, and further makes it possible to obtain high quality images which result in neither offset nor image dust. Further, it is possible to apply said toner to various types of fixing devices.

It is possible to advantageously apply the toner, which is prepared employing the resinous composition of the present invention, to a flash fixing device employing a flash lamp described in Japanese Patent Publication Open to Public Inspection No. 7-199715, U.S. Pat. No. 5,151,743, and others; a heated belt fixing device employing a heated film as described in Japanese Patent Publication Open to Public Inspection Nos. 8-6409 and 8-76515; and further, a heated roller fixing device as described in Japanese Patent Publication Open to Public Inspection No. 8-76515.

EXAMPLES

The present invention is described specifically with reference to the examples which follow below. However, the present invention is not limited to these examples.

Example 1

<<Preparation of Resinous Composition P-1>>

Placed in a 3-liter capacity separable flask were 900 g of toluene, and 500 g of a vinyl based copolymer (having a weight average molecular weight Mw of 10,000, being comprised of 90 weight percent of a styrene component and 10 weight percent of a methyl methacrylate component). Thereafter, the gas phase was replaced with nitrogen gas, and the resulting mixture was heated to the boiling point of toluene. In the state in which toluene is subjected to reflux, a mixed solution of 150 g of n-butyl methacrylate monomer, 500 g of methyl methacrylate monomer, and 3 g of benzoyl peroxide was added dropwise while stirring, and solution polymerization was carried out. Thereafter, said toluene was removed by heating the resulting mixture to 180° C. under reduced pressure. Thus Resinous Composition P-1 was obtained. The molecular weight distribution of the obtained Resinous Composition P-1 was determined employing GPC. The results made it possible to confirm that the molecular weight distribution had peaks at the weight average molecular weight of 10,000 and 600,000.

<Confirmation of Domain Structure>

A thin slice of the obtained Resinous Composition P-1, which was prepared employing an ultra-microtome, was observed employing a transmission type electron microscope. Thereby it was possible to confirm that the domain phase comprised of n-butyl methacrylate-methyl methacrylate, which was obtained by polymerization growth, and the crystalline polyester was in the matrix phase formed by a styrene-methyl methacrylate copolymer which was added as the vinyl based copolymer, and that the average diameter of the entire domain phase was 0.5 $\mu$m.

<<Preparation of Resinous Composition P-2>>

Placed in a 3-liter capacity separable flask were 900 g of toluene, and 500 g of a vinyl based copolymer (having a weight average molecular weight Mw of 10,000, being comprised of 90 weight percent of a styrene component and 10 weight percent of a methyl methacrylate component), and further placed were 150 g of crystalline polyester resin (HP-320 of Nihon Gosei Kagaku) (having a TSp of 80° C.). The resulting mixture was subjected to dispersion while stirring. Thereafter, the gas phase was replaced with nitrogen gas, and the resulting mixture was heated to the boiling point of toluene. At the state in which toluene is subjected to reflux, a mixed solution consisting of 150 g of n-butyl methacrylate monomer, 500 g of methyl methacrylate monomer, and 3 g of benzoyl peroxide was added dropwise while stirring, and solution polymerization was carried out. Thereafter, said toluene was removed by heating the resulting mixture to 180° C. under reduced pressure. Thus Resinous Composition P-2 was obtained. The molecular weight distribution of the obtained Resinous Composition P-2 was determined employing GPC. The results made it possible to confirm that the molecular weight distribution had peaks at the weight average molecular weight of 10,000 and 600,000.

<Confirmation of Domain Structure>

A thin slice of the obtained Resinous Composition P-2, which was prepared employing an ultra-microtome, was observed employing a transmission type electron microscope. Thereby it was possible to confirm that the domain phase comprised of n-butyl methacrylate-methyl methacrylate, which was obtained by polymerization growth, and the crystalline polyester was formed in the matrix phase formed by a styrene-methyl methacrylate copolymer which was added as the vinyl based copolymer, and that the average diameter of the entire domain phase was 0.5 $\mu$m.

The domain diameter was measured as follows. The average diameter in the fere horizontal direction, which was magnified at a factor of 50,000 employing a transmission type electron microscope, was obtained. Observation was carried out for 100 domains and the arithmetic average diameter was determined.

<<Preparation of Resinous Composition P-3>>

Placed in a 3-liter capacity separable flask were 900 g of toluene, and 500 g of a vinyl based copolymer (having a weight average molecular weight Mw of 10,000, being comprised of 90 weight percent of a styrene component and 10 weight percent of methyl methacrylate), and 150 g of crystalline polyester resin (HP-320 of Nihon Gosei Kagaku) (having a Tsp of 80° C.) and 50 g of Compatibilizers S-1 (refer to the description below) were further placed. The resulting mixture was subjected to dispersion while stirring. Thereafter, the gas phase was replaced with nitrogen gas, and the resulting mixture was heated to the boiling point of toluene. In the state in which toluene is subjected to reflux, a mixed solution consisting of 150 g of n-butyl methacrylate monomer, 500 g of methyl methacrylate monomer, and 3 g of benzoyl peroxide was added dropwise while stirring, and then solution polymerization was carried out. Thereafter, toluene was removed by heating the resulting mixture to 180° C. under reduced pressure. Thus Resinous Composition P-3 was obtained. The molecular weight distribution of the obtained Resinous Composition P-3 was determined employing GPC. The results made it possible to confirm that the molecular weight distribution had peaks at the weight average molecular weight of 10,000 and 600,000.

<Confirmation of Domain Structure>

A thin slice of the obtained Resinous Composition P-3, which was prepared employing an ultra-microtome, was observed employing a transmission type electron microscope. Thereby it was possible to confirm that the domain phase comprised of n-butyl methacrylate-methyl methacrylate, which was obtained by polymerization growth, and the crystalline polyester was formed in the matrix phase formed by a styrene-methyl methacrylate copolymer which was added as the vinyl based copolymer, and that the average diameter of entire domain phase was 0.25 $\mu$m.

(Preparation of Compatibilizers)

Placed in a 1-liter capacity round reaction vessel were 400 g of deionized water, 3.6 g gum Arabic, and 3.6 g of lignosulfonic acid, and the vessel was set in a water bath. Then said vessel was equipped with a stirring device, a Dimroth condensing pipe, a dripping device, and a nitrogen supplying tube, and the resulting mixture was subjected to nitrogen bubbling while stirring, and was heated to 80° C. Thereafter, the nitrogen bubbling was replaced with a nitrogen gas flow, and a mixed monomer solution comprised of 81.2 g of styrene monomer, 18.8 g of n-butyl acrylate monomer, 25 g of methyl methacrylate monomer, and 0.6 g of benzoyl peroxide was added dropwise, and suspension polymerization was then carried out. After 18 hours, the reaction product was removed, washed with water, and filtered. The resulting reaction product was then dried. Thus styrene-n-butyl acrylate-methyl methacrylate copolymer (St-BA-MMA copolymer) was obtained as Compatibilizer S-1.

<<Preparation of Resinous Composition P-4>>

Placed in a 3-liter capacity separable flask were 900 g of toluene, and 500 g of a vinyl based copolymer (having a weight average molecular weight Mw of 10,000, being comprised of 90 weight percent of a styrene component and 10 weight percent of methyl methacrylate), and 50 g of the aforementioned Compatibilizer S-1 were further placed. The resulting mixture was subjected to dispersion while stirring. Thereafter, the gas phase was replaced with nitrogen gas, and the resulting mixture was heated to the boiling point of toluene. At the state in which toluene is subjected to reflux, a mixed solution of 150 g of n-butyl methacrylate monomer, 500 g of methyl methacrylate monomer, and 3 g of benzoyl peroxide was added dropwise while stirring, and solution polymerization was carried out. Thereafter, said toluene was removed by heating the resulting mixture to 180 ° C. under reduced pressure. Thus Resinous Composition P-4 was obtained. The molecular weight distribution of the obtained Resinous Composition P-4 was determined employing GPC. The results made it possible to confirm that the molecular weight distribution had peaks at the weight average molecular weight of 10,000 and 600,000.

<Confirmation of Domain Structure>

A thin slice of the obtained Resinous Composition P-4, which was prepared employing an ultra-micro tome, was observed employing a transmission type electron microscope. Then it was possible to confirm that the domain phase comprised of n-butyl methacrylate-methyl methacrylate, which was obtained by polymerization growth, was formed in the matrix phase formed by a styrene-methyl methacrylate copolymer which was added as the vinyl based copolymer, and that the average diameter of entire domain phase was 0.3 $\mu$m.

<<Preparation of Resinous Composition P-5>>

Placed in a 3-liter capacity separable flask were 900 g of toluene, and 300 g of a vinyl based copolymer (having a weight average molecular weight Mw of 6,000, being comprised of 75 weight percent of a styrene component, 5 weight percent of n-butyl methacrylate, and 20 weight percent of methyl methacrylate), and 250 g of crystalline polyester resin (HP-320 of Nihon Gosei Kagaku) (having a Tsp of 80° C.) and 150 g of Compatibilizers S-1 were further placed. The resulting mixture was subjected to dispersion while stirring. Thereafter, the gas phase was replaced with nitrogen gas, and the resulting mixture was heated to the boiling point of toluene. At the state in which toluene is subjected to reflux, a mixed solution of 440 g of n-butyl methacrylate monomer, 100 g of methyl methacrylate monomer, and 3 g of benzoyl peroxide was added dropwise while stirring, and solution polymerization was carried out. Thereafter, toluene was removed by heating the resulting mixture to 180° C. under reduced pressure. Thus Resinous Composition P-5 was obtained. The molecular weight distribution of the obtained Resinous Composition P-5 was determined employing GPC. The results made it possible to confirm that the molecular weight distribution had peaks at the weight average molecular weight of 6,000 and 800,000.

<Confirmation of Domain Structure>

A thin slice of the obtained Resinous Composition P-5, which was prepared employing a ultra-microtome, was observed employing a transmission type electron microscope. Then it was possible to confirm that the domain phase comprised of crystalline polyester and n-butyl methacrylate-methyl methacrylate was formed in the matrix phase formed by a vinyl based copolymer, and the average diameter of the domain phase was 0.4 $\mu$m.

<<Preparation of Toners>>

Employing obtained Resinous Compositions P-1 through P-5, toners were prepared as follows. (Toner Particles T-1 is shown as the representative example.)

<Preparation of Toner Particles T-1>

The obtained Resinous Composition P-1 was coarsely crushed employing a hammer mill so that crushed particles would pass through a 2 mm mesh. The crushed resinous component was blended with 4 weight percent of stearyl stearate and 10 weight percent of carbon black with respect to the resinous component and the resulting blend was stirred and mixed employing a Henschel mixer. Thereafter, the resulting mixture was melt kneaded employing a biaxial extrusion kneader and the obtained melt-kneaded material was cooled and then coarsely crushed employing a hammer mill and subsequently pulverized employing a mechanical type pulverizer (turbo mill manufactured by Turbo Kogyo Co.). Thereafter, the pulverized particles were subjected to classified employing air separation for classification employing a Microplex and thus Colored Particles C-1 were obtained.

With respect to obtained Colored Particles C-1, added were 0.8 weight percent of fine silica particles and 0.5 weight percent of fine Titania particles, and external addition was carried out by mixing the resulting mixture employing a Henschel mixer. Thus Toner Particles T-1 were obtained.

<Preparation of Toner Particles T-2>

Toner Particles T-2 were obtained in the same manner as said Toner Particles T-1, except that stearyl stearate in Toner Particles T-1 was replaced with 4 weight percent of Compound No. 4 (E4).

<Preparation of Toner Particles T-3>

Obtained Resinous Composition P-1 was coarsely crushed employing a hammer mill so that crushed particles passed through a mesh diameter of 2 mm. The crushed resinous component was blended with 3 weight percent of stearyl stearate, 0.3 weight percent of stearic acid, and 10 weight percent of carbon black with respect to the resinous component, and the resulting blend was stirred and mixed employing a Henschel mixer. Thereafter, the resulting mixture was melt kneaded employing a biaxial extrusion kneader and the obtained melt kneaded material was cooled and then coarsely crushed employing a hammer mill and then pulverized employing a mechanical type pulverizer (turbo mill manufactured by Turbo Kogyo Co.). Thereafter, the pulverized particles were subjected air separation for classification employing a Microplex and thus Colored Particles C-3 were obtained.

With respect to obtained Colored Particles C-3, added were 0.8 weight percent of fine silica particles and 0.5 weight percent of fine titania particles, and external addition was carried out by mixing the resulting mixture employing a Henschel mixer. Thus Toner Particles T-3 were obtained.

<Preparation of Toner Particles T-4>

Toner Particles T-4 was obtained in the same manner as said Toner Particles T-3, except that 3 weight percent of stearyl stearate was replaced with 4 weight percent of Compound No. 4 (E4) and 0.3 weight percent of stearic acid was replaced with 0.2 weight percent of behenic acid.

<Preparation of Toner Particles T-5>

Obtained Resinous Composition P-1 was coarsely crushed employing a hammer mill so that crushed particles passed through a mesh diameter of 2 mm. The crushed resinous component was blended with 4 weight percent of stearyl stearate, 2 weight percent of a charge control agent (Comparative cpd.) as comparison, and 10 weight percent of carbon black with respect to the resinous component, and the resulting blend was stirred and mixed employing a Henschel mixer. Thereafter, the resulting mixture was melt kneaded employing a biaxial extrusion kneader and the obtained melt kneaded material was cooled and then coarsely crushed employing a hammer mill and then pulverized employing a mechanical type pulverizer (turbo mill manufactured by Turbo Kogyo Co.). Thereafter, the pulverized particles are subjected to air separation for classification employing a Microplex and thus Colored Particles C-5 were obtained.

With respect to obtained Colored Particles C-5, added were 0.8 weight percent of fine silica particles and 0.5 weight percent of fine Titania particles, and external addition was carried out by mixing the resulting mixture employing a Henschel mixer. Thus Toner Particles T-5 were obtained.

Comparative cpd.

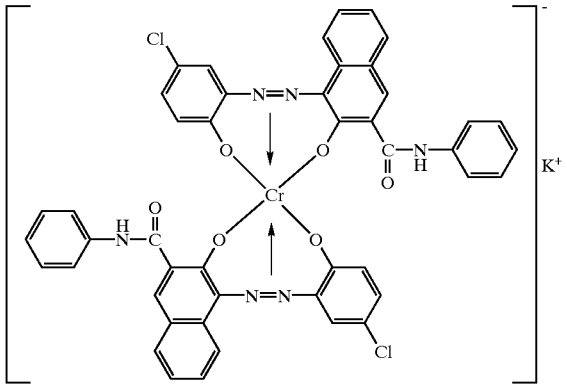

<Preparation of Toner Particles T-6>

Obtained Resinous Composition P-1 was coarsely crushed employing a hammer mill so that crushed particles passed through a mesh diameter of 2 mm. The crushed resinous component was blended with 4 weight percent of stearyl stearate, 2 weight percent of the compound represented by the exemplified structural formula (1) among compounds represented by the general formula (3) of the present invention as the charge control agent, and 10 weight percent of carbon black with respect to the resinous component, and the resulting blend was stirred and mixed employing a Henschel mixer. Thereafter, the resulting mixture was melt kneaded employing a biaxial extrusion kneader and the obtained melt kneaded material was cooled and then coarsely crushed employing a hammer mill and then pulverized employing a mechanical type pulverizer (turbo mill manufactured by Turbo Kogyo Co.). Thereafter, the pulverized particles are subjected to air separation for classification employing a Microplex and thus Colored Particles C-6 were obtained.

With respect to obtained Colored Particles C-5, added were 0.8 weight percent of fine silica particles and 0.5 weight percent of fine Titania particles, and external addition was carried out by mixing the resulting mixture employing a Henschel mixer. Thus Toner Particles T-6 was obtained.

As described above, employing Resinous Compositions P-1 through P-5, Toner Particles T-1 through T-40 were prepared in which the other components were replaced with those as shown in Table 1. Further, stearyl stearate (SS) used as the ester compound, Ester Compound No. 4 (E4), and stearic acid used as carboxylic acid, which were shown in general formulas (1) and (2), and charge control agents were employed in the same amount employed to prepare the aforementioned Toner Particles T-1 through T-6, and polypropylene (Viscol 660P), which was an olefin based wax, was added in an amount of 3 weight percent with respect to the resinous component. Further the toner particle diameter was controlled employing the dispersion degree which was regulated by crushing conditions of the hammer mill and classification.

<<Measurement of Toner Diameter>>

The particle diameter of each of obtained Toner Particles T-1 through T-40 was measured employing a diffraction type particle size distribution measuring apparatus (HELOS, manufactured by Sinpatekku Co.). Measured values were expressed by volume standard 10 percent particle diameter D10, volume standard 50 percent particle diameter D50, and volume standard 90 percent particle diameter D90, and the results are shown in Tables 1 and 2.

<<Preparation of Developer Materials>>

Each of Toner Particles T-1 through T-40, as prepared above, was blended with a silicone coated carrier (volume standard 50 percent particle diameter of 60 $\mu$m), which was prepared by applying a silicone resin onto magnetite particles, so that the toner concentration in a developer material was 5 percent by weight, and the resulting blend was mixed employing a W cone mixer. Thus Developer Materials D-1 through D-40 employed for evaluation were obtained.

<<Evaluation of Performance>>

1. Evaluation of Fixable Temperature Range

The heated roll fixing device in a high speed digital copier Konica 7050, manufactured by Konica Corp, was modified so the temperature of said heated roll would be set as desired. Thereafter, obtained Developer Materials D-1 through D-40 were successively placed in said copier, and fixed images were prepared while varying the temperature of the heated roll from 130 to 240° C. at increments of 10° C. The fixing strength of obtained fixed images was evaluated employing a fixing ratio obtained by a method in accordance with a mending tape peeling method described in Chapter 1, Item 1.4 of "Denshishasin Gijitsu no Kiso to Oyo (Fundamentals and Application of Electrophotographic Technolgy, edited by Densishashin Gakkai (Electrophotogrphic Society)". The density of images was measured employing a Macbeth Reflection Densitometer RD-918. The fixing temperature, at which 90 percent of the fixing ratio was obtained, was designated as a fixable temperature.

The performance of each toner was classified into 5 levels based on the evaluation of each fixable temperature.

| Performance Level | Fixable Temperature (in ° C.) |
|---|---|
| 5 | 130 to 240 |
| 4 | 140 to 230 |

-continued

| Performance Level | Fixable Temperature (in ° C.) |
|---|---|
| 3 | 150 to 230 |
| 2 | 160 to 220 |
| 1 | 180 to 200 |

Herein, those evaluated at least at level 2, that is, the range of the fixable temperature is at least 60° C., were judged to be commercially viable.

2. Evaluation of Offset Formation

Developer Materials D-1 through D-40 were successively placed in a high speed digital copier, Konica 7050, manufactured by Konica Corp., and 1,000 A4 sheets were continually copied at an ambience of a low temperature and a low humidity, 10° C. and 20% RH, respectively. Then, resulting images and the surface of the heated roll, after copying 1,000 sheets, were visually observed, and the offset formation was evaluated according to the three levels described below.

A no formation of offset

B formation on the fixing roller but no formation on images

C many offset formation areas which cause problems in actual use Levels A and B were judged to be a commercially viable level.

3. Evaluation of Image Dust Generation

Developer Materials D-1 through D-40 were successively placed in a high speed digital copier, Konica 7050, manufactured by Konica Corp., and 1,000 A4 sheets were continually copied at an ambience of a low temperature and a low humidity, 10° C. and 20% RH respectively. A fine line image in the obtained images was observed employing a microscope. The generation of toner dust in the area adjacent to fine lines was evaluated according to the three levels described below.

A no generating dust

B generation of dust was observed, which was at a level resulting in no problem for practical use C much particulate generation was observed, which resulted in major problems for practical use Levels A and B were judged to be employable in actual practice.

TABLE 1

| Toner No. | Resinous Composition | Low Melting Point Crystalline Compound | Compati-bilizer | General Formulas (1) and (2) | Charge Control Agent |
|---|---|---|---|---|---|
| T-1 | P-1 | | | SS | |
| T-2 | P-1 | | | E4 | |
| T-3 | P-1 | | | SS + SA | |
| T-4 | P-1 | | | E4 + BA | |
| T-5 | P-1 | | | SS | comparative cpd |
| T-8 | P-1 | | | SS + SA | comparative cpd |
| T-9 | P-1 | | | SS + SA | (1) |
| T-10 | P-1 | | | E4 + BA | (2) |
| T-11 | P-2 | HP-320 | | SS | |
| T-12 | P-2 | HP-320 | | SS + SA | |
| T-13 | P-2 | HP-320 | | SS + SA | comparative cpd |

TABLE 1-continued

| | | | | |
|---|---|---|---|---|
| T-14 | P-2 | HP-320 | SS + SA | (1) |
| T-15 | P-2 | HP-320 | E4 + BA | (2) |
| T-16 | P-2 | HP-320 | | comparative cpd |
| T-18 | P-1 | | SS + SA | |
| T-19 | P-2 | HP-320 | SS + SA | |

| Toner No. | Polyolefin Component | Particle Diameter in μm D10 | D50 | D90 | Evaluation Fixable Temperature | Offset | Dust | |
|---|---|---|---|---|---|---|---|---|
| T-1 | | 5.0 | 8.0 | 11.5 | 1 | C | C | comparative |
| T-2 | | 4.6 | 7.5 | 10.8 | 1 | C | C | comparative |
| T-3 | | 5.0 | 7.0 | 9.8 | 2 | B | A | present invention |
| T-4 | | 5.1 | 7.0 | 9.8 | 2 | B | A | present invention |
| T-5 | | 5.8 | 8.2 | 10.4 | 1 | B | B | comparative |
| T-8 | | 6.1 | 8.2 | 10.5 | 2 | B | B | present invention |
| T-9 | | 5.5 | 7.0 | 8.9 | 3 | B | A | present invention |
| T-10 | | 5.4 | 7.1 | 8.8 | 3 | B | A | present invention |
| T-11 | | 6.0 | 8.5 | 10.8 | 1 | C | C | comparative |
| T-12 | | 5.5 | 6.8 | 8.2 | 2 | B | A | present invention |
| T-13 | | 5.6 | 6.8 | 8.5 | 3 | B | A | present invention |
| T-14 | | 5.4 | 6.8 | 8.4 | 3 | B | A | present invention |
| T-15 | | 5.5 | 6.8 | 8.5 | 3 | B | A | present invention |
| T-16 | | 6.0 | 8.5 | 11.0 | 1 | B | B | comparative |
| T-18 | Viscol 660P | 5.5 | 6.8 | 8.2 | 3 | B | A | present invention |
| T-19 | Viscol 660P | 5.3 | 6.6 | 7.8 | 2 | B | A | present invention |

HP-320: crystalline polyester resin (Nihon Gosei Kagaku)
SS: stearyl stearate
SA: stearic acid
E4: Ester Compound No. 4
BA: behenic acid
Viscol 660P: polypropylene based polyolefin wax releasing agent

TABLE 2

| Toner No. | Resinous Composition | Low Melting Point Crystalline Compound | Compatibilizer | General Formulas (1) and (2) | Charge Control Agent |
|---|---|---|---|---|---|
| T-22 | P-1 | | | SS + SA | (1) |
| T-23 | P-2 | HP-320 | | SS + SA | (1) |
| T-24 | P-2 | HP-320 | | E4 + BA | (2) |
| T-25 | P-4 | | S-1 | SS | |
| T-26 | P-4 | | S-1 | SS + SA | |
| T-27 | P-4 | | S-1 | SS + SA | (1) |
| T-28 | P-4 | | S-1 | SS + SA | (1) |
| T-29 | P-4 | | S-1 | SS + SA | (1) |
| T-30 | P-4 | | S-1 | SS + SA | (2) |
| T-31 | P-4 | | S-1 | SS + SA | |
| T-32 | P-4 | | S-1 | E4 + BA | |
| T-33 | P-3 | HP-320 | S-1 | SS + SA | |
| T-35 | P-3 | HP-320 | S-1 | SS + SA | |
| T-36 | P-3 | HP-320 | S-1 | SS + SA | (1) |
| T-37 | P-3 | HP-320 | S-1 | E4 + BA | (1) |
| T-38 | P-5 | HP-320 | S-1 | E4 + BA | |

TABLE 2-continued

| | | | | | | |
|---|---|---|---|---|---|---|
| T-39 | P-5 | HP-320 | S-1 | SS + SA | (2) | |
| T-40 | P-5 | HP-320 | S-1 | E4 + BA | (2) | |

| Toner No. | Polyolefin Component | Particle Diameter in μm D10 | D50 | D90 | Evaluation Fixable Temperature | Offset | Dust | |
|---|---|---|---|---|---|---|---|---|
| T-22 | Viscol 660P | 5.4 | 6.5 | 7.8 | 3 | B | A | present invention |
| T-23 | Viscol 660P | 5.4 | 6.5 | 7.8 | 4 | A | A | present invention |
| T-24 | Viscol 660P | 5.4 | 6.5 | 7.8 | 5 | A | A | present invention |
| T-25 | | 6.0 | 8.8 | 10.4 | 1 | C | C | comparative |
| T-26 | | 5.2 | 7.0 | 8.8 | 2 | B | A | present invention |
| T-27 | | 5.6 | 7.0 | 8.8 | 4 | B | A | present invention |
| T-28 | | 5.6 | 7.0 | 8.9 | 4 | B | A | present invention |
| T-29 | Viscol 660P | 5.5 | 6.8 | 8.2 | 4 | A | A | present invention |
| T-30 | Viscol 660P | 5.4 | 6.8 | 8.2 | 4 | A | A | present invention |
| T-31 | Viscol 660P | 5.4 | 6.8 | 8.3 | 3 | A | A | present invention |
| T-32 | Viscol 660P | 5.3 | 6.5 | 8.2 | 4 | A | A | present invention |
| T-33 | | 5.3 | 6.5 | 8.1 | 3 | A | A | present invention |
| T-35 | Viscol 660P | 5.0 | 6.5 | 8.2 | 3 | A | A | present invention |
| T-36 | Viscol 660P | 6.1 | 7.2 | 9.0 | 5 | A | A | present invention |
| T-37 | Viscol 660P | 5.8 | 7.2 | 8.8 | 5 | A | A | present invention |
| T-38 | Viscol 660P | 5.2 | 6.8 | 8.5 | 4 | A | A | present invention |
| T-39 | Viscol 660P | 5.2 | 6.8 | 8.5 | 5 | A | A | present invention |
| T-40 | Viscol 660P | 4.7 | 6.0 | 7.3 | 5 | A | A | present invention |

HP-320: crystalline polyester resin (Nihon Gosei Kagaku)
SS: stearyl stearate
SA: stearic acid
E4: Ester Compound No. 4
BA: behenic acid
Viscol 660P: polypropylene based polyolefin wax releasing agent As can be seen from Tables 1 and 2, the toner particles of the present invention exhibit a wide fixable temperature range and excellent performance in the formation of offset as well as dust compared to particles which are not covered by the present invention.

Example 2

The heated roll fixing device in a high speed digital copier Konica 7050, manufactured by Konica Corp, was modified to the same heated belt fixing device which was described in FIG. 2 of Japanese Patent Publication Open to Public Inspection No. 8-76515, and further was modified so that temperature was set optionally. Further, three types of toner, T-24, T-35, and T-40, were selected from toner particles prepared in Example 1. Except for these, performance evaluation was carried out in the same manner as Example 1. Table 3 shows the performance evaluation results.

TABLE 3

| Toner No. | Fixable Temperature Range | Offset Formation | Image Dust Formation |
|---|---|---|---|
| T-24 | 130 to 240° C. | none | none |
| T-36 | 130 to 240° C. | none | none |
| T-40 | 130 to 240° C. | none | none |

Example 3

Performance evaluation was carried out in the same manner as Example 2, except that the heated roll fixing device was replaced with a heated roll fixing device described in FIG. 1 of Japanese Patent Publication Open to Public Inspection No. 8-76515, which had a heat generating member adjacent to the roll surface which was employed for the performance evaluation. Table 4 shows the performance evaluation results.

TABLE 4

| Toner No. | Fixable Temperature Range | Offset Formation | Image Dust Formation |
|---|---|---|---|
| T-24 | 130 to 240° C. | none | none |
| T-36 | 130 to 240° C. | none | none |
| T-40 | 130 to 240° C. | none | none |

Example 4

Performance evaluation was carried out in the same manner as Example 2, except that the heated roll fixing device was replaced with a fixing device employing a flash lamp, described in Japanese Patent Publication Open to Public Inspection No. 7-199715. Incidentally, as the fixing temperature, the surface temperature of fixed images during flashing was recorded. Table 5 shows the performance evaluation results.

TABLE 5

| Toner No. | Fixable Temperature Range | Offset Formation | Image Dust Formation |
|---|---|---|---|
| T-24 | 130 to 240° C. | none | none |
| T-36 | 130 to 240° C. | none | none |
| T-40 | 130 to 240° C. | none | none |

It is possible to obtain a toner which exhibits sufficient fixing strength in a wide fixable temperature range, makes it possible to obtain high quality fixed images having neither offset nor image dust, and is capable of being applied to various types of fixing means.

What is claimed is:

1. An electrophotographic toner comprising a resinous composition for toner and a colorant wherein the resinous composition comprises a copolymer including a lower molecular weight component having a peak at molecular weight of 3,000 to 50,000 and a higher molecular weight component having a peak at molecular weight of 100,000 to 5,000,000, the copolymer comprising a vinyl based copolymer comprised of a styrene based monomer and an acrylic or methacrylic acid ester based monomer as structural units, and the toner comprises a fatty acid ester represented by at least one of the general formulas (1-1) through (1-4), and a carboxylic acid represented by the general formula (2), $R_1COOR_2$ General Formula (1-1)

in the formula, one or both of $R_1$ and $R_2$ represent an aliphatic group having not less than 14 carbon atoms and when either $R_1$ or $R_2$ represents an aliphatic group having not less than 14 carbon atoms, the other group represents an alkyl group having not more than 14 carbon atoms, a cycloalkyl group, an alkenyl group, or an aralkyl group, $[R_1COO—(CH_2)_n]_a—C—[(CH_2)_m—OCOR_2]_b$ General Formula (1-2)

in the formula, a and b each represents an integer of 0 to 4; a+b is 4; $R_1$ and $R_2$ each represents an organic group having from 1 to 40 carbon atoms; the difference in the number of carbon atoms between $R_1$ and $R_2$ is to be at least 3; m and n each represents an integer of 0 to 25; and m and n are not 0 at the same time, $[R_1COO—(CH_2)_n]_a—C—[(CH_2)_m—OH]_b$ General Formula (1-3)

in the formula, a represents an integer of 1 to 3; b represents an integer of 1 to 3; a+b is 4; $R_1$ represents an organic group having from 1 to 40 carbon atoms; m and n each represents an integer of 0 to 25; and m and n are not 0 at the same time, $[R_1COO—(CH_2)_n]_a—C(R_3)_k—[CH_2]_m—OCOR_2]_b$ General Formula (1-4)

in the formula, a and b each represents an integer of 0 to 3; a+b is 1 to 3, $R_1$ and $R_2$ each represents an organic group having from 1 to 40 carbon atoms; the difference in the number of atoms between $R_1$ and $R_2$ is at least 3; $R_3$ represents a hydrogen atom or an organic group having at least 1 carbon atom with proviso, when a+b is 2, either one of $R_3$ represents an organic group having at least 1 carbon atom; k represents an integer of 1 to 3; m and n each represents an integer of 0 to 25; and m and n are not 0 at the same time, $R_4—COOH$ General Formula (2)

in the formula, $R_4$ represents a saturated or unsaturated aliphatic group having at least 13 carbon atoms.

where in content of the carboxylic acid represented by the general formula (2) is 0.001 to 5 percent by weight with respect to the resinous component.

2. The electrophotographic toner of claim 1 wherein the toner further comprises a compound represented by general formula (3),

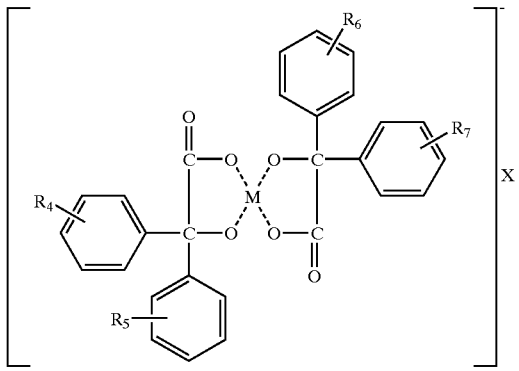

in the formula, $R_4$ through $R_7$ each represents a hydrogen atom or a univalent substituent; these may be substituted or may have a ring structure including a condensed ring, $R_4$ through $R_7$ may be the same or different, M represents a trivalent metal, and X represents a univalent or divalent positive ion which neutralizes the electrical charge.

3. The electrophotographic toner of claim 2 wherein $R_4$ through $R_7$ each represents a halogen atom, an alkyl group, an alkoxy group, an aryl group, an aralkyl group, a hydroxyl group, a carboxyl group, a nitro group or a cyano group.

4. The electrophotographic toner of claim 2 wherein M represents Cr, Al, Fe, Co, Ti or B.

5. The electrophotographic toner of claim 4 wherein M represents Cr, Al, Fe, Co, Ti or B, and content of the compound represented by general formula (3) is 0.1 to 10 weight parts with respect to 100 weight parts of the resinous composition.

6. The electrophotographic toner of claim 2 wherein content of the compound represented by general formula (3) is 0.1 to 10 weight parts with respect to 100 weight parts of the resinous composition.

7. The electrophotographic toner of claim 1 wherein the lower molecular weight component has a weight average molecular weight distribution in a range of 5,000 to 20,000 and the higher molecular weight component has a weight average molecular weight distribution in a range of 500,000 to 2,000,000.

8. The electrophotographic toner of claim 7 wherein the resinous component comprises 5 to 40 weight % of the higher molecular weight component, and 60 to 95 weight % of the lower molecular weight component having glass transition temperature of not less than 50° C., softening point of 80 to 150° C. and Mw/Mn of not more than 5.

9. The electrophotographic toner of claim 7 wherein content of the fatty acid ester represented by the general formulas (1-1) through (1-4) is 0.05 to 20 percent by weight, content of the carboxylic acid represented by the general formula (2) is 0.001 to 5 percent by weight with respect to the resinous component, and the crystalline compound is polyester having a melting point of 50 to 130° C. and content of the crystalline compound is 1 to 30 percent by weight with respect to the resinous composition.

10. The electrophotographic toner of claim 9 wherein the fatty acid ester is represented by formula (1-2).

11. The electrophotographic toner of claim 1 wherein glass transition temperature of the lower molecular weight component is not less than 50° C., and content of the lower molecular weight component of the copolymer is 60 to 95 weight percent by weight with respect to the entire resinous components.

12. The electrophotographic toner of claim 1 wherein content of the higher molecular weight component of the copolymer is 5 to 40 weight percent by weight with respect to the entire resinous components.

13. The electrophotographic toner of claim 1 wherein the lower molecular weight component of the copolymer has softening point of 80 to 150° C. and Mw/Mn of not more than 5.

14. The electrophotographic toner of claim 1 wherein content of the fatty acid ester represented by the general formulas (1-1) through (1-4) is 0.05 to 20 percent by weight with respect to the resinous component.

15. The electrophotographic toner of claim 1 wherein volume standard 10 percent average particle diameter D10, volume standard 50 percent average particle diameter D50, and volume standard 90 percent average particle diameter D90 satisfy relation of $$D10>0.5\times D50$$

$$D90<1.5\times D50.$$

16. A developer of an electrostatic latent image containing toner of claim 1.

17. An electrophotographic toner comprising a resinous composition for toner and a colorant wherein the resinous composition comprises a copolymer including a lower molecular weight component having a peak at molecular weight of 3,000 to 50,000 and a higher molecular weight component having a peak at molecular weight of 100,000 to 5,000.000, the copolymer comprising a vinyl based copolymer comprised of a styrene based monomer and and acrylic or methacrylic acid ester based monomer as structural units, and the toner comprises a fatty acid ester represented by at least one of the general formulas (1-1) through (1-4), and a carboxylic acid represented by the general formula (2), $$R_1COOOR_2 \qquad \text{General Formula (1-1)}$$

in the formula, one or both of $R_1$ and $R_2$ represent an aliphatic group having not less than 14 carbon atoms and when either $R_1$ or $R_2$ represents an aliphatic group having not less than 14 carbon atoms, the other group represents an alkyl group having not more than 14 carbon atoms, a cycloalkyl group, an alkenyl group, or an aralkyl group, $$[R_1COO—(CH_2)_n]_a—C—[(CH_2)_m—OCOR_2]_b \qquad \text{General Formula (1-2)}$$

in the formula, a and b each represents an integer of 0 to 4; a+b is 4; $R_1$ and $R_2$ each represents an organic group having from 1 to 40 carbon atoms; the difference in the number or carbon atoms between $R_1$ and $R_2$ is to be at least 3; m and n each represents an integer of 0 to 25; and m and n are not 0 a the same time, $$[R_1COO—(CH_2)_n]_a—C—[(CH_2)_m—OH]_b \qquad \text{General Formula (1-3)}$$

in the formula, a represents an integer of 1 to 3; b represents an integer of 1 to 3; a +b is 4; $R_1$ represents an organic group having from 1 to 40 carbon atoms; m and n each represents an integer of 0 to 25; and m and n are not 0 at the same time, $$[R_1COO—(CH_3)_n]_a—C(R_3)_k—[CH_2]_m—OCOR_2]_b \qquad \text{General Formula (1-4)}$$

in the formula, a and b each represents an integer of 0 to 3; a+b is 1 to 3; $R_1$ and $R_2$ each represents an organic group having from 1 of 40 carbon atoms; the difference in the number of atoms between $R_1$ and $R_2$ is at least 3; $R_3$ represents a hydrogen atom or an organic group having at least 1 carbon atom with proviso, when a+b is 2, either one of R3 represents an organic group having at least 1 carbon atom; k represents an integer of 1 to 3; m and n each represents an integer of 0 to 25; and m and n are not 0 at the same time, $$R_4—COOH \qquad \text{General Formula (2)}$$

in the formula, $R_4$ represents a saturated or unsaturated aliphatic group having at least 13 carbon atoms, and wherein a content ratio of the fatty acid ester represented by the general formulas (1-1) through (1-4) is 80.0 to 99.9 percent by weight, acid of the carboxylic acid represented by the general formula (2) is 0.1 to 20 percent by weight.

18. An electrophotographic toner comprising a resinous composition for toner and a colorant wherein the resinous composition comprises a copolymer including a lower molecular weight component having a peak at molecular weight of 3,000 to 50,000 and a higher molecular weight component having a peak at molecular weight of 100,000 to 5,000,000, the copolymer comprising a vinyl based copolymer comprised of a styrene base monomer and an acrylic or metacrylic acid ester based monomer as structural units, and the toner comprises a fatty acid ester represented by at least one of the general formulas (1-1) through (1-4), and a carboxylic acid represented by the general formula (2), $R_1COOR_2$ General Formula (1-1)

in the formula, one or both of $R_1$ and $R_2$ represent an aliphatic group having not less than 14 carbon atoms and when either $R_1$ or $R_2$ represents an aliphatic group having not less than 14 carbon atoms, the other group represents an alkyl group having not more than 14 carbon atoms, a cycloalkyl group, an alkenyl group, or an aralkyl group, $[R_1COO—(CH_2)_n]_a—C—[(CH_2)_m—OCOR_2]_b$ General Formula (1-2)

in the formula, a and b each represents an integer of 0 to 4; a+b is 4; $R_1$ and $R_2$ each represents an organic group having form 1 to 40 carbon atoms; to difference in the number of carbon atoms between $R_1$ and $R_2$ is to be at least 3; m and n each represents an integer of 0 to 25; and m and in are not 0 at the same time, $[R_1COO—(CH_2)_n]_a—C—[(CH_2)_m—OH]_b$ General Formula (1-3)

in the formula, a represents an integer of 1 to 3; b represents an integer of 1 to 3; a+b is 4; $R_1$ represents an organic group having from 1 to 40 carbon atoms; in and n each represents an integer of 0 to 25; and m and n are not 0 at the same time, $[R_1COO—(CH_2)_n]_a—C(R_3)_k—[CH_2]_m—OCOR_2]_b$ General Formula (1-4)

in the formula, a and b each represents an integer of 0 to 3; a+b is 1 to 3; $R_1$ and $R_2$ each represents an organic group having from 1 to 40 carbon atoms; the difference in the number of atoms between $R_1$ and $R_2$ is at least 3; $R_3$ represents a hydrogen atom or an organic group having at least 1 carbon atom with proviso, when a+b is 2, either one of $R_3$ represents an organic group having al least 1 carbon atom; k represents an integer of 1 to 3; m and n each represents an integer of 0 to 25; and m and n are not 0 at the same time, $R_4—COOH$ General Formula (2)

in the formula, $R_4$ represents a saturated or unsaturated aliphatic group having at least 13 carbon atoms, and wherein the toner further comprises a crystalline compound having a terminal polar group.

19. The electrophotographic toner of claim 18 wherein the terminal polar group is a hydroxyl group.

20. The electrophotographic toner of claim 18, wherein the terminal polar group is selected from —OH, —COOH, —CHO, —CN, or a halogen atom.

21. The electrophotographic toner of claim 18 wherein the crystalline compound has a melting point of 50 to 130° C.

22. The electrophotographic toner of claim 18 wherein content of the crystalline compound is 1 to 30 percent by weight with respect to the resinous composition.

23. The electrophotographic toner of claim 18 wherein the crystalline compound is polyester having a melting point of 50 to 130° C. and content of the crystalline compound is 1 to 30 percent by weight with respect to the resinous composition.

24. The electrophotographic toner of claim 18 wherein the toner further comprises a compound represented by general formula (3),

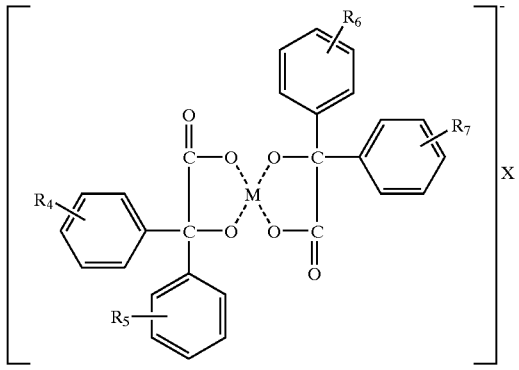

in the formula, $R_4$ through $R_7$ each represents a hydrogen atom or a univalent substituent; these may be substituted or may have a ring structure including a condensed ring, $R_4$ through $R_7$ may be the same or different, M represents a trivalent metal, and X represents a univalent or divalent positive ion which neutralizes the electrical charge.

25. The electrophotographic toner of claim 24 wherein $R_4$ through $R_7$ each represents a halogen atom, an alkyl group, an alkoxy group, an aryl group, an aralkyl group, a hydroxyl group, a carboxyl group, a nitro group or a cyano group.

26. The electrophotographic toner of claim 24 wherein M represents Cr, Al, Fe, Co, Ti or B.

27. The electrophotographic toner of claim 26 wherein M represents Cr, Al, Fe, Co, Ti or B, and content of the compound represented by general formula (3) is 0.1 to 10 weight parts with respect to 100 weight parts of the resinous composition.

28. The electrophotographic toner of claim 24 wherein content of the compound represented by general formula (3) is 0.1 to 10 weight parts with respect to 100 weight parts of the resinous composition.

29. The electrophotographic toner of claim 18 wherein the lower molecular weight component has a weight average molecular weight distribution in a range of 5,000 to 20,000 and the higher molecular weight component has a weight average molecular weight distribution in a range of 500,000 to 2,000,000.

30. The electrophotographic toner of claim 29 wherein the resinous component comprises 5 to 40 weight % of the higher molecular weight component, and 60 to 95 weight % of the lower molecular weight component having glass transition temperature of not less than 50° C., softening point of 80 to 150° C. and Mw/Mn of not more than 5.

31. The electrophotographic toner of claim 29 wherein content of the fatty acid ester represented by the general formulas (1-1) through (1-4) is 0.05 to 20 percent by weight, content of the carboxylic acid represented by the general formula (2) is 0.001 to 5 percent by weight with respect to the resinous component, and the crystalline compound is polyester having a melting point of 50 to 130° C. and content of the crystalline compound is 1 to 30 percent by weight with respect to the resinous composition.

32. The electrophotographic toner of claim 31 wherein the fatty acid ester is represented by formula (1-2).

* * * * *

UNITED STATES PATENT AND TRADEMARK OFFICE

CERTIFICATE OF CORRECTION

PATENT NO. : 6,475,688 B1 
APPLICATION NO. : 09/651172
DATED : November 5, 2002
INVENTOR(S) : Tamura et al.

It is certified that error appears in the above-identified patent and that said Letters Patent is hereby corrected as shown below:

Column: 36
Line 9, before "in" delete "$R_1C000R_2$" and insert therefor -- $R_1C00R_2$ --
Line 18, after "$(CH_2)_m]$" delete "$(CH_2)_n]_n$" and insert therefor -- $(CH_2)_n]_a$--
Line 24, after "number" delete "or" and insert therefor -- of --
Line 29, after "-OH]" delete "$_h$" and insert therefor -- $_b$ --
Line 55, after "weight" delete "acid" and insert therefor -- and --

Column 37:
Line 25, after "and" delete "in" and insert therefor -- n --
Line 31, before "and" delete "in" and insert therefor -- m --
Line 43, after "having" delete "al" and insert therefor -- at --

Signed and Sealed this

Seventeenth Day of April, 2007

JON W. DUDAS
*Director of the United States Patent and Trademark Office*